US012222139B2

(12) United States Patent
Mahmoud et al.

(10) Patent No.: US 12,222,139 B2
(45) Date of Patent: Feb. 11, 2025

(54) HEAT PUMP WITH EJECTOR

(71) Applicant: Carrier Corporation, Palm Beach Gardens, FL (US)

(72) Inventors: Ahmad M. Mahmoud, Windsor, CT (US); Parmesh Verma, Manlius, NY (US); Zuojun Shi, Marcellus, NY (US); Frederick J. Cogswell, Glastonbury, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 198 days.

(21) Appl. No.: 18/100,370

(22) Filed: Jan. 23, 2023

(65) Prior Publication Data

US 2023/0160610 A1 May 25, 2023

Related U.S. Application Data

(63) Continuation-in-part of application No. 16/989,603, filed on Aug. 10, 2020, now Pat. No. 11,561,028, (Continued)

(51) Int. Cl.
*F25B 13/00* (2006.01)
*F25B 30/02* (2006.01)
(Continued)

(52) U.S. Cl.
CPC ..... *F25B 13/00* (2013.01); *F25B 30/02* (2013.01); *F25B 41/00* (2013.01); *F25B 41/20* (2021.01);
(Continued)

(58) Field of Classification Search
CPC ..... F25B 49/02; F25B 2400/23; F25B 30/02; F25B 41/00; F25B 2400/0407;
(Continued)

(56) References Cited

U.S. PATENT DOCUMENTS 4,057,976 A 11/1977 del Toro et al.
4,240,269 A 12/1980 Bussjager
(Continued)

FOREIGN PATENT DOCUMENTS

CN 1573258 A 2/2005
CN 101031754 A 9/2007
(Continued)

OTHER PUBLICATIONS

European Office Action dated Mar. 11, 2024 for European Patent Application No. 16805692.7.
(Continued)

*Primary Examiner* — Elizabeth J Martin
(74) *Attorney, Agent, or Firm* — Bachman & LaPointe, P.C.

(57) ABSTRACT

A system has: a compressor having a suction port and a discharge port; an ejector having a motive flow inlet, a suction flow inlet, and an outlet; a separator having an inlet, a vapor outlet, and a liquid outlet; a first heat exchanger; an expansion device; and a second heat exchanger. Conduits and valves are positioned to provide alternative operation in: a cooling mode and a heating mode. In the cooling mode, a needle of the ejector is closed. In the heating mode refrigerant passes sequentially from a first section of the second heat exchanger to a second section. In the cooling mode refrigerant passes in parallel through the first section and the second section.

15 Claims, 15 Drawing Sheets

Related U.S. Application Data which is a continuation of application No. 15/776,561, filed as application No. PCT/US2016/062759 on Nov. 18, 2016, now Pat. No. 10,739,052.

(60) Provisional application No. 63/396,768, filed on Aug. 10, 2022, provisional application No. 62/258,345, filed on Nov. 20, 2015.

(51) Int. Cl.

| | |
|---|---|
| ***F25B 41/00*** | (2021.01) |
| ***F25B 41/20*** | (2021.01) |
| ***F25B 43/00*** | (2006.01) |
| ***F25B 49/02*** | (2006.01) |

(52) U.S. Cl.

CPC ..... *F25B 43/003* (2013.01); *F25B 43/006* (2013.01); *F25B 49/02* (2013.01); *F25B 2313/02741* (2013.01); *F25B 2341/0011* (2013.01); *F25B 2341/0013* (2013.01); *F25B 2400/23* (2013.01); *F25B 2700/2106* (2013.01)

(58) Field of Classification Search

CPC ..... F25B 13/00; F25B 43/006; F25B 2313/02741; F25B 2700/2106

See application file for complete search history.

(56) References Cited

U.S. PATENT DOCUMENTS

| | | | |
|---|---|---|---|
| 4,262,493 | A | 4/1981 | Lackey et al. |
| 4,306,421 | A | 12/1981 | Gucwa, Jr. et al. |
| 5,165,254 | A | 11/1992 | Kountz et al. |
| 6,550,265 | B2 | 4/2003 | Takeuchi et al. |
| 6,584,794 | B2 | 7/2003 | Takeuchi et al. |
| 6,834,514 | B2 | 12/2004 | Takeuchi et al. |
| 7,178,360 | B2 | 2/2007 | Ogata et al. |
| 8,713,962 | B2 | 5/2014 | Okazaki |
| 9,416,993 | B2 | 8/2016 | Hong |
| 2002/0124592 | A1 | 9/2002 | Takeuchi et al. |
| 2004/0003608 | A1 | 1/2004 | Takeuchi et al. |
| 2004/0011065 | A1 | 1/2004 | Takeuchi et al. |
| 2004/0103685 | A1 | 6/2004 | Yamaguchi et al. |
| 2004/0255610 | A1 | 12/2004 | Nishijima et al. |
| 2005/0011221 | A1 | 1/2005 | Hirota |
| 2005/0028552 | A1 | 2/2005 | Nishijima et al. |
| 2005/0155374 | A1 | 7/2005 | Oshitani et al. |
| 2006/0156745 | A1 | 7/2006 | Ikegami et al. |
| 2006/0254308 | A1 | 11/2006 | Yokoyama et al. |
| 2008/0041079 | A1 | 2/2008 | Nishijima et al. |
| 2008/0282725 | A1 | 11/2008 | Ishibashi et al. |
| 2012/0180510 | A1 | 7/2012 | Okazaki et al. |
| 2013/0042640 | A1 | 2/2013 | Higashiiue et al. |
| 2013/0125569 | A1 | 5/2013 | Verma et al. |
| 2017/0211853 | A1 | 7/2017 | Feng et al. |

FOREIGN PATENT DOCUMENTS

| | | | |
|---|---|---|---|
| CN | 102575882 | A | 7/2012 |
| CN | 102844632 | A | 12/2012 |
| JP | 2008-116124 | A | 5/2008 |
| WO | 2015/116480 | A1 | 8/2015 |
| WO | 2016/014144 | A1 | 1/2016 |

OTHER PUBLICATIONS

Chinese Reexamination Notice dated Mar. 5, 2024 for Chinese Patent Application No. 201680067273.5.

International Search Report and Written Opinion dated Feb. 1, 2017 for PCT Patent Application No. PCT/US2016/062759.

Chinese Office Action dated Dec. 27, 2019 for Chinese Patent Application No. 201680067273.5.

US Office Action dated Sep. 27, 20219 for U.S. Appl. No. 15/776,561.

US Office Action dated Jan. 13, 2020 for U.S. Appl. No. 15/776,561.

Chinese Office Action dated Jul. 31, 2020 for Chinese Patent Application No. 201680067273.5.

Chinese Office Action dated Dec. 21, 2020 for Chinese Patent Application No. 201680067273.5.

US Office Action dated Nov. 30, 2021 for U.S. Appl. No. 16/989,603.

European Office Action dated Sep. 7, 2021 for European Patent Application No. 16805692.7.

HEAT PUMP WITH EJECTOR

CROSS-REFERENCE TO RELATED APPLICATIONS

Benefit is claimed of U.S. Patent Application No. 63/396,768, filed Aug. 10, 2022, and entitled "Heat Pump with Ejector", and this is a continuation in part of U.S. patent application Ser. No. 16/989,603, filed Aug. 10, 2020, and entitled "Heat Pump with Ejector, which is a continuation of U.S. patent application Ser. No. 15/776,561, filed May 16, 2018, now U.S. Pat. No. 10,739,052 and entitled "Heat Pump with Ejector", which is a 371 US national stage application of PCT/US2016/062759, filed Nov. 18, 2016, which claims benefit of U.S. Patent Application No. 62/258,345, filed Nov. 20, 2015, and entitled "Heat Pump with Ejector", the disclosures of all of which applications are incorporated by reference herein in their entireties as if set forth at length.

BACKGROUND

The disclosure relates to heat pumps. More particularly, the disclosure relates to heat pumps featuring an ejector.

Vapor compression systems have long been used for air conditioning. An exemplary vapor compression air conditioner comprises a refrigerant compressor, an outdoor heat exchanger downstream of the compressor along a refrigerant flowpath, an expansion device downstream of the outdoor heat exchanger, and an indoor heat exchanger downstream of the expansion device prior to the refrigerant flowpath returning to the compressor. Refrigerant is compressed in the compressor. Refrigerant then rejects heat in the outdoor heat exchanger and loses temperature. An exemplary outdoor heat exchanger is a refrigerant-air heat exchanger wherein fan-forced outdoor air acquires heat from refrigerant. By rejecting heat, the refrigerant may condense from vapor to liquid in the heat rejection heat exchanger. Accordingly, such exchangers are often referred to as condensers. In other systems, the refrigerant remains vapor and such are referred to as gas coolers.

The refrigerant expands in the expansion device and decreases in temperature. The reduced temperature of the refrigerant thus absorbs heat in the heat absorption heat exchanger (e.g., evaporator). Again, the evaporator may be a refrigerant-air heat exchanger across which a fan-forced interior/indoor airflow is driven with the interior/indoor airflow rejecting heat to the refrigerant.

Such vapor compression systems may also be used to heat interior spaces. In such cases, the refrigerant flow direction is altered to pass first from the compressor to the indoor heat exchanger and return from the outdoor heat exchanger to the compressor. Such arrangements are referred to as heat pumps.

In addition to simple expansion devices such as orifices and valves, ejectors have been used as expansion devices. Ejectors are particularly efficient where there is a large temperature difference between the indoor and outdoor environments.

An exemplary ejector is formed as the combination of a motive (primary) nozzle nested within an outer member or body. The ejector has a motive flow inlet (primary inlet) which may form the inlet to the motive nozzle. The ejector outlet may be the outlet of the outer member. A motive/primary refrigerant flow enters the inlet and then passes into a convergent section of the motive nozzle. It then passes through a throat section and an expansion (divergent) section and through an outlet of the motive nozzle. The motive nozzle accelerates the flow and decreases the pressure of the flow. The ejector has a secondary inlet forming an inlet of the outer member. The pressure reduction caused to the primary flow by the motive nozzle helps draw a suction flow or secondary flow into the outer member through the suction port. The outer member may include a mixer having a convergent section and an elongate throat or mixing section. The outer member also has a divergent section or diffuser downstream of the elongate throat or mixing section. The motive nozzle outlet may be positioned within the convergent section. As the motive flow exits the motive nozzle outlet, it begins to mix with the suction flow with further mixing occurring through the mixing section which provides a mixing zone.

Ejectors may be used with a conventional refrigerant or a $CO_2$-based refrigerant. In an exemplary operation with $CO_2$, the motive flow may typically be supercritical upon entering the ejector and subcritical upon exiting the motive nozzle. The secondary flow is gaseous (or a mixture of gas with a smaller amount of liquid) upon entering the secondary inlet. The resulting combined flow is a liquid/vapor mixture and decelerates and recovers pressure in the diffuser while remaining a mixture.

U.S. Pat. No. 6,550,265 of Takeuchi et al., issued Apr. 22, 2003, and entitled "Ejector Cycle System" discloses switching arrangements for use of an ejector in a cooling mode and a heating mode. US Patent Application Publication 2012/0180510A1 of Okazaki et al., published Jul. 19, 2012, and entitled "Heat Pump Apparatus" discloses a configuration with ejector and non-ejector heating modes and a non-ejector defrost mode. Additionally, PCT/US2015/030709 of Feng et al., filed May 14, 2015, and entitled "Heat Pump with Ejector" discloses a configuration with alternative ejector and non-ejector heating modes and a non-ejector cooling mode.

SUMMARY

One aspect of the disclosure involves a system comprising: a compressor having a suction port and a discharge port; an ejector having a motive flow inlet, a suction flow inlet, and an outlet; a separator having an inlet, a vapor outlet, and a liquid outlet; a first heat exchanger; at least one expansion device; a second heat exchanger; and a plurality of conduits and a plurality of valves. The ejector is a controllable ejector having a needle shiftable between a closed position and a plurality of open positions. The conduits and valves are positioned to provide alternative operation in: a cooling mode; a first heating mode; and a second heating mode.

In one or more embodiments, in the cooling mode, a flowpath segment passes from the first heat exchanger through a first expansion device of the at least one expansion device to the second heat exchanger and the needle is in the closed position to block flow from the motive flow inlet. In the first heating mode, a flowpath segment passes from the second heat exchanger through the motive flow inlet, the separator inlet and liquid outlet, and the first expansion device and to the first heat exchanger. In the second heating mode, a flowpath segment passes from the second heat exchanger through the first expansion device to the first heat exchanger and the ejector has a suction flow and the needle is in the closed position to block flow from the motive flow inlet.

In one or more embodiments, in the cooling mode wherein the needle is in the closed position to block flow from the motive flow inlet. In the first heating mode wherein a flowpath segment passes from the second heat exchanger through the motive flow inlet, the separator inlet and liquid outlet, and the expansion device and to the first heat exchanger. In the second heating mode wherein the needle is in the closed position to block flow from the motive flow inlet.

In one or more embodiments of any of the foregoing embodiments, in the cooling mode, the ejector has a secondary flow.

In one or more embodiments of any of the foregoing embodiments, the system has only a single said ejector.

In one or more embodiments of any of the foregoing embodiments, the system has only a single said expansion device.

In one or more embodiments of any of the foregoing embodiments, the system has only a single four-port switching valve and no three-port switching valves.

In one or more embodiments of any of the foregoing embodiments, the plurality of conduits comprises a first conduit between the first heat exchanger and the second heat exchanger; the at least one expansion device comprises an expansion device along the first conduit; the plurality of conduits comprises a second conduit between the separator liquid outlet and the first conduit; and the plurality of valves comprises a check valve the second conduit.

In one or more embodiments of any of the foregoing embodiments, the first conduit comprises: a trunk between the first heat exchanger and the expansion device; a first branch to a first port on the second heat exchanger; and a second branch extending to a second port on the second heat exchanger.

In one or more embodiments of any of the foregoing embodiments, the plurality of valves comprises a check valve along the first branch and a two way valve along the second branch.

In one or more embodiments of any of the foregoing embodiments, the plurality of conduits comprises a conduit extending from the second branch to the motive flow inlet.

In one or more embodiments of any of the foregoing embodiments, a controller is configured to switch the system between: running in the cooling mode; running in the first heating mode; and running in the second heating mode.

In one or more embodiments of any of the foregoing embodiments, the controller is configured to switch the system between said first heating mode and said second heating mode based on a sensed outdoor temperature.

In one or more embodiments of any of the foregoing embodiments, a method for using the system comprises: running in the cooling mode; running in the first heating mode; and running in the second heating mode.

In one or more embodiments of any of the foregoing embodiments, the method further comprises selecting which of the first heating mode and second heating mode in which to run based at least partially on a sensed outdoor temperature.

In one or more embodiments of any of the foregoing embodiments, a switching between at least two of the modes comprises actuating a single 4-way switching valve and no 3-way switching valve.

In one or more embodiments of any of the foregoing embodiments, the switching between at least two of the modes comprises a switching between at least two of the modes comprises actuating a single 4-way switching valve, no 3-way switching valves, and one or more of 2-way valves.

In one or more embodiments of any of the foregoing embodiments: in the cooling mode, a first portion of refrigerant exiting tubes of the second heat exchanger passes through a check valve of the plurality of valves to merge with a second portion and, in turn, pass from a port of the second heat exchanger; and in the first heating mode and second heating mode, refrigerant enters the port of the second heat exchanger into the tubes and from the tubes out a second port.

Another aspect of the disclosure involves a system comprising: a compressor having a suction port and a discharge port; an ejector having a motive flow inlet, a suction flow inlet, and an outlet, the ejector being a controllable ejector having a needle shiftable between a closed position and a plurality of open positions; a separator having an inlet, a vapor outlet, and a liquid outlet; a first heat exchanger; an expansion device; a second heat exchanger having a first section and a second section; and a plurality of conduits and a plurality of valves. The conduits and valves are positioned to provide alternative operation in: a cooling mode wherein the needle is in the closed position to block flow from the motive flow inlet; and a heating mode wherein a flowpath segment passes from the second heat exchanger through the motive flow inlet, the separator inlet and liquid outlet, and the expansion device and to the first heat exchanger. The plurality of valves are positioned so that: in the heating mode refrigerant passes sequentially from the first section to the second section; and in the cooling mode refrigerant passes in parallel through the first section and the second section.

In one or more embodiments of any of the foregoing embodiments, the first heat exchanger comprises: a first manifold; a second manifold; and a third manifold. In the cooling mode refrigerant passes through a first section of the first heat exchanger and a second section of the first heat exchanger in series. In the heating mode refrigerant passes through the first section of the first heat exchanger and the second section of the first heat exchanger in parallel.

In one or more embodiments of any of the foregoing embodiments: the first heat exchanger first section is larger than the first heat exchanger second section; and the second heat exchanger first section is larger than the second heat exchanger second section.

In one or more embodiments of any of the foregoing embodiments, a size ratio of the first heat exchanger first section to the first heat exchanger second section is smaller than a size ratio of the second heat exchanger first section to the second heat exchanger second section.

In one or more embodiments of any of the foregoing embodiments, the system has only a single ejector.

In one or more embodiments of any of the foregoing embodiments: the heating mode is a first heating mode; the plurality of conduits and the plurality of valves are further positioned to provide alternative operation in a second heating mode wherein the needle is in the closed position to block flow from the motive flow inlet; and the plurality of valves are positioned so that in the second heating mode refrigerant passes sequentially from the first section to the second section.

In one or more embodiments of any of the foregoing embodiments, the system further comprises a controller configured to switch the system between: running in the cooling mode; running in the first heating mode; and running in the second heating mode.

In one or more embodiments of any of the foregoing embodiments, the controller is configured to switch the system between said first heating and said second heating mode based on a sensed outdoor temperature.

In one or more embodiments of any of the foregoing embodiments, the first heat exchanger comprises: a first port; a second port; a first check valve of said plurality of valves positioned to block flow from the first manifold to the second manifold; a second check valve of said plurality of valves positioned to block flow from the second port to the second manifold; and a third check valve of said plurality of valves positioned to block flow from the third manifold to the second port.

Another aspect of the disclosure involves a system comprising: a compressor having a suction port and a discharge port; an ejector having a motive flow inlet, a suction flow inlet, and an outlet, the ejector being a controllable ejector having a needle shiftable between a closed position and a plurality of open positions; a separator having an inlet, a vapor outlet, and a liquid outlet; a first heat exchanger; at least one expansion device; a second heat exchanger; and a plurality of conduits and a plurality of valves. The conduits and valves are positioned to provide alternative operation in: a cooling mode wherein a flowpath segment passes from the first heat exchanger through a first expansion device of the at least one expansion device to the second heat exchanger and the needle is in the closed position to block flow from the motive flow inlet; a first heating mode wherein a flowpath segment passes from the second heat exchanger through the motive flow inlet, the separator inlet and liquid outlet, and the first expansion device and to the first heat exchanger; and a second heating mode wherein a flowpath segment passes from the second heat exchanger through the first expansion device to the first heat exchanger, the ejector has a suction flow and the needle is in the closed position to block flow from the motive flow inlet. The first heat exchanger comprises: a first manifold; a second manifold; a third manifold. In the cooling mode refrigerant passes through a first section of the first heat exchanger and a second section of the first heat exchanger in series. In the first heating mode refrigerant passes through the first section of the first heat exchanger and the second section of the first heat exchanger in parallel.

In one or more embodiments of any of the foregoing embodiments, the first heat exchanger comprises: a first port; a second port; a first check valve of said plurality of valves positioned to block flow from the first manifold to the second manifold; a second check valve of said plurality of valves positioned to block flow from the second port to the second manifold; and a third check valve of said plurality of valves positioned to block flow from the third manifold to the second port.

Another aspect of the disclosure involves a system comprising: a compressor having a suction port and a discharge port; an ejector having a motive flow inlet, a suction flow inlet, and an outlet, the ejector being a controllable ejector having a needle shiftable between a closed position and a plurality of open positions; a separator having an inlet, a vapor outlet, and a liquid outlet; a first heat exchanger; at least one expansion device other than the ejector; a second heat exchanger; and a plurality of conduits and a plurality of valves. The conduits and valves are positioned to provide alternative operation in: a cooling mode wherein a flowpath segment passes from the first heat exchanger through a first expansion device of the at least one expansion device to the second heat exchanger and the needle is in the closed position to block flow from the motive flow inlet; and a first heating mode wherein a flowpath segment passes from the second heat exchanger through the motive flow inlet, the separator inlet and liquid outlet, and the first expansion device and to the first heat exchanger. The first heat exchanger comprises: a first manifold; a second manifold; a third manifold. In the cooling mode refrigerant passes through a first section of the first heat exchanger and a second section of the first heat exchanger in series. In the first heating mode refrigerant passes through the first section of the first heat exchanger and the second section of the first heat exchanger in parallel.

In one or more embodiments of any of the foregoing embodiments, the first heat exchanger comprises: a first port; a second port; a first check valve of said plurality of valves positioned to block flow from the first manifold to the second manifold; a second check valve of said plurality of valves positioned to block flow from the second port to the second manifold; and a third check valve of said plurality of valves positioned to block flow from the third manifold to the second port.

In one or more embodiments of any of the foregoing embodiments, the second heat exchanger has a first section and a second section; and the plurality of valves are positioned so that: in the first heating mode refrigerant passes sequentially from the second heat exchanger first section to the second heat exchanger second section; and in the cooling mode refrigerant passes in parallel through the second heat exchanger first section and the second heat exchanger second section.

In one or more embodiments of any of the foregoing embodiments, the plurality of conduits and the plurality of valves are positioned to further provide operation in: a second heating mode wherein: a flowpath segment passes from the second heat exchanger through the first expansion device to the first heat exchanger; and the ejector has a suction flow and the needle is in the closed position to block flow from the motive flow inlet.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
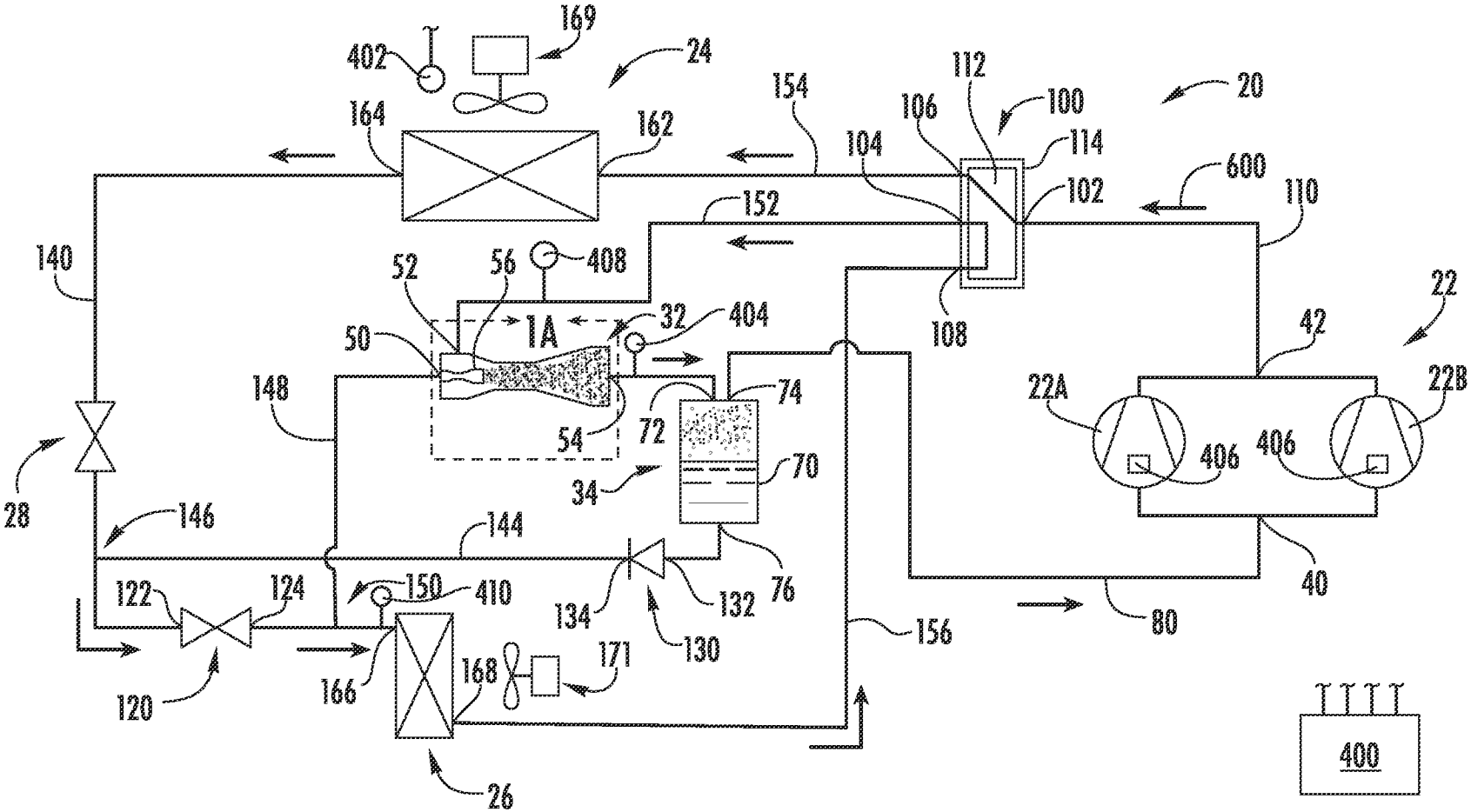
FIG. 1 is a schematic view of a vapor compression system showing refrigerant flow directions associated with a cooling mode.

FIG. 1 shows a vapor compression system 20 comprising one or more compressors 22 (22A and 22B shown in parallel) for driving a flow of refrigerant along a recirculating flowpath. The system further includes at least one first heat exchanger 24 and at least one second heat exchanger 26. In an example, the system can operate as a heat pump or air conditioner, in this case the first heat exchanger is an outdoor heat exchanger (coil) and the second heat exchanger is an indoor heat exchanger (coil).

In the FIG. 1 cooling or air conditioning mode, the first heat exchanger 24 is a heat rejection heat exchanger and the second heat exchanger 26 is a heat absorption heat exchanger. In certain air temperature control examples, both heat exchangers may be refrigerant-air heat exchangers. In other examples, such as chillers, one or both heat exchangers may be a refrigerant-water heat exchanger, a refrigerant-brine heat exchanger, or the like.

Figure 2:
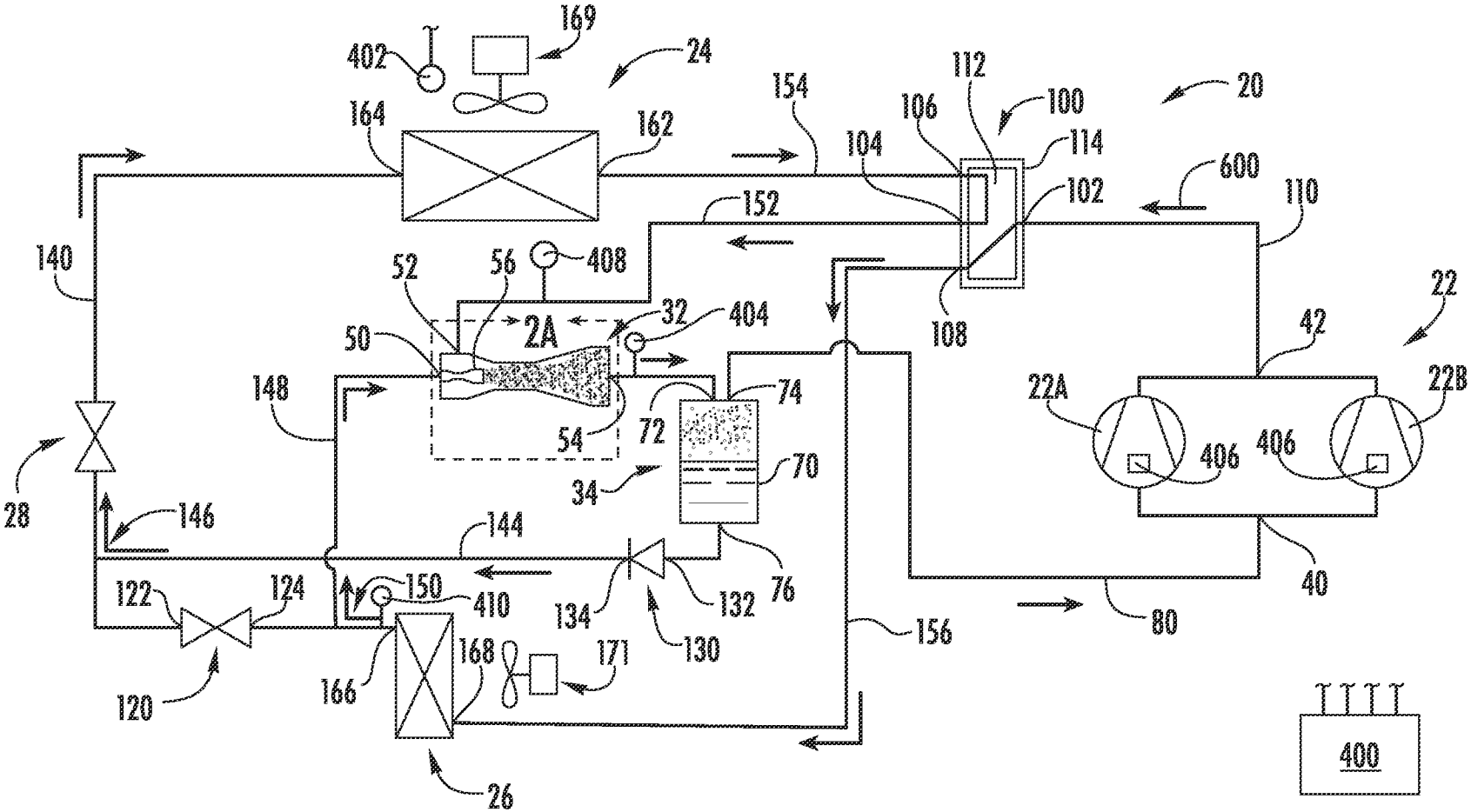
FIG. 2 is a schematic view of the system of FIG. 1 showing refrigerant flow directions associated with a first heating mode.
Figure 3:
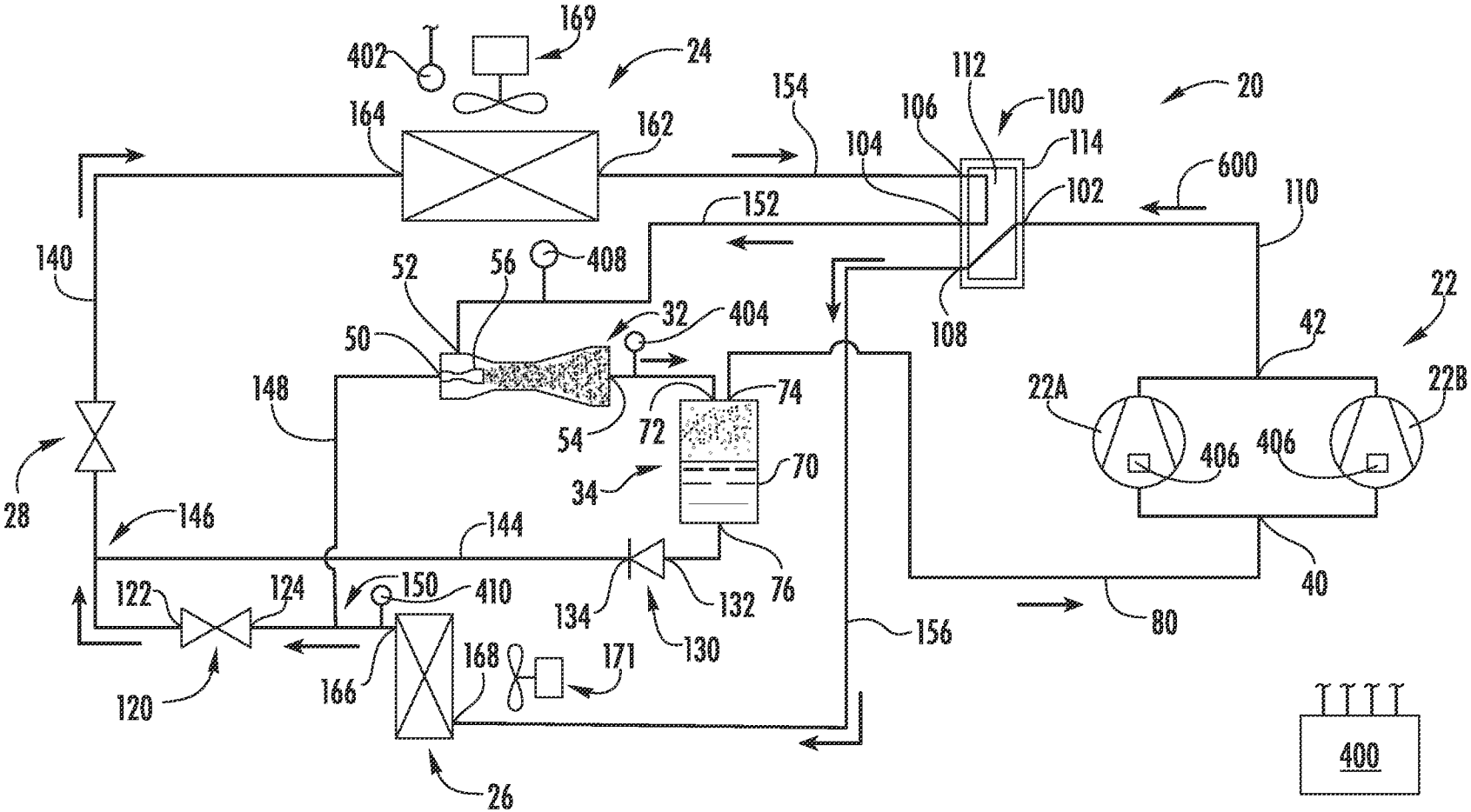
FIG. 3 is a schematic view of the system of FIG. 1 showing refrigerant flow directions associated with a second heating mode.

In the FIG. 2 and FIG. 3 heat pump (heating) modes, the thermal functions of the two heat exchangers are essentially reversed relative to the FIG. 1 cooling mode. The heat exchanger 24 is a heat absorption heat exchanger and the heat exchanger 26 is a heat rejection heat exchanger.

The system can include one or more expansion devices 28 (e.g., an electronic expansion valve (EEV or EXV), not an ejector). As is discussed further below, the system also includes an ejector 32 and a separator 34. The FIG. 2 and FIG. 3 modes differ from each other in at least the roles of the expansion device, ejector, and separator. The FIG. 2 mode makes full use of the ejector as an expansion device and may be used in a relatively low ambient temperature range. The FIG. 3 mode effectively disables the ejector (e.g., no motive flow or essentially no motive flow as would be associated with internal leakage levels of flow which are insufficient for driving the associated flows through the suction port) and relies on one or more of the other expansion devices (e.g., the expansion device 28). The FIG. 3 mode may be used in a relatively high ambient temperature range. The exemplary FIG. 1 mode also disables the ejector. For example, the boundary between low and high may be selected for efficient operation. The ejector loses efficiency at lower temperature differences. For heat pump operation, lower temperature differences are associated with higher ambient temperatures. Control may be responsive to measured temperature difference or responsive to sensed ambient temperature (it being assumed that the target indoor temperature will always be about a typical value). Particular desirable boundaries will depend on the particular refrigerant and construction details of the system. For many systems an appropriate boundary is likely to be associated with an ambient (outdoor) temperature in the range of 30F (−1.1° C.) to 47° F. (8.3° C.). An alternative upper limit is 60° F. (15.6° C.). Typical temperature (indoor vs. outdoor) differences if controlled based on the difference would be in the range of at least 10° F. (5.6° C.) or at least 23° F. (12.8° C.).

The compressor 22 has a suction port (inlet) 40 and a discharge port (outlet) 42. The ejector comprises a motive flow inlet (primary inlet) 50, a suction flow inlet (secondary flow inlet) 52, and an outlet 54. The exemplary ejector comprises a motive flow nozzle (motive nozzle) 56 positioned to receive a motive flow (e.g., in the FIG. 2 mode) through the motive flow inlet 50 upstream of a mixing location for flow delivered through the suction flow inlet 52.

The exemplary motive nozzle 56 (FIG. 1A) is a convergent-divergent nozzle having an exit 57 within a convergent portion of a mixer 58 upstream of a straight mixing portion. A divergent diffuser 59 extends downstream from the mixer. The exemplary ejector is a controllable ejector having a control needle 60 (FIG. 1A) and an actuator 61. The actuator 61 shifts a tip portion 62 of the needle into and out of the throat section 63 of the motive nozzle 56 to modulate flow through the motive nozzle and, in turn, the ejector overall. The actuator 61 can be electrically driven (e.g., solenoid, stepper motor, or the like), mechanically driven, or driven by any suitable means known in the art. The actuator may be coupled to and controlled by a controller 400 (FIG. 1; discussed below). Exemplary controllable ejectors are found in U.S. Pat. No. 7,178,360 and International Publication WO2015/116480 A1. The exemplary needle has a fully extended fully closed/sealed/seated position/condition (FIG. 1A) and a stepwise or continuous plurality of open positions/conditions (one shown in FIG. 2A) retracted relative thereto.

Figure 1A:
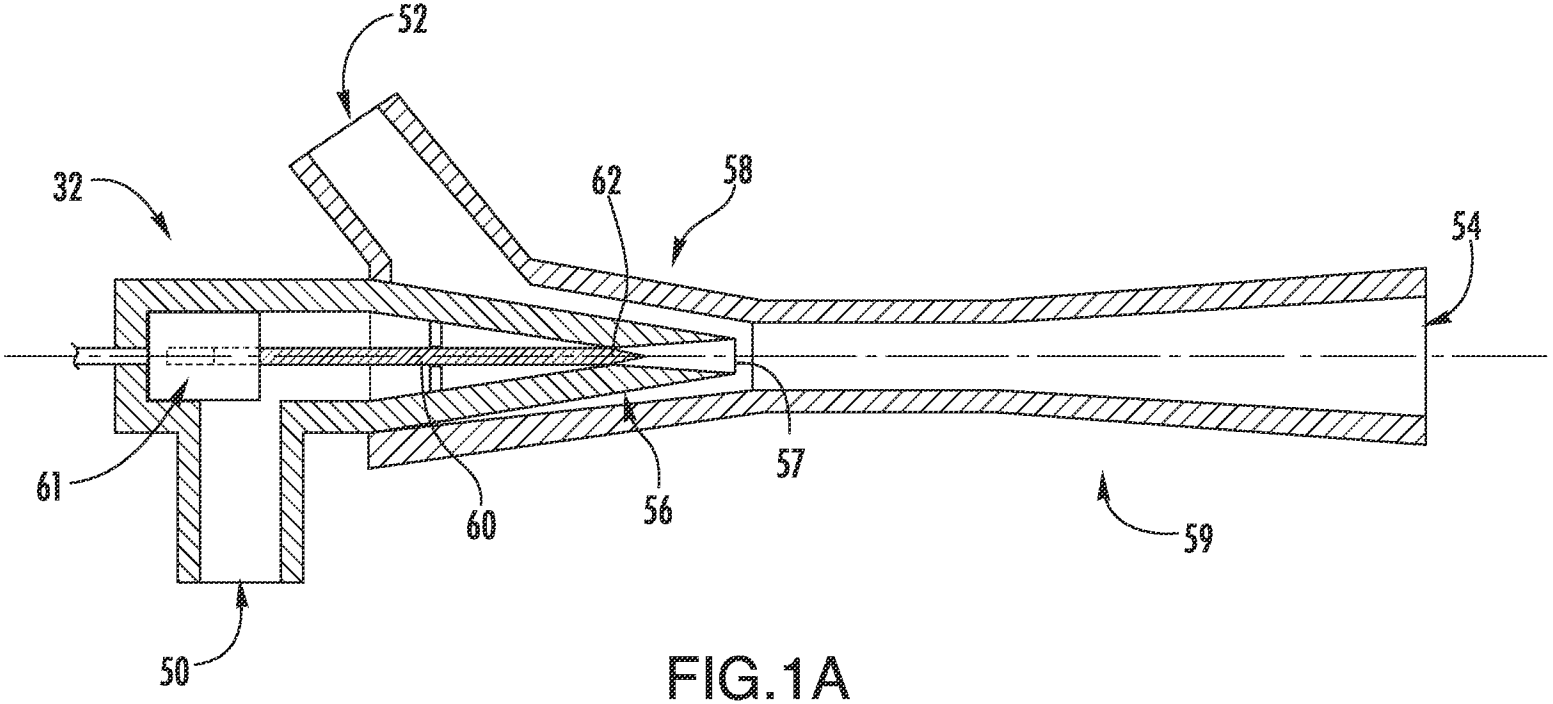
FIG. 1A is a schematic view of an ejector of the system of FIG. 1.
Figure 2A:
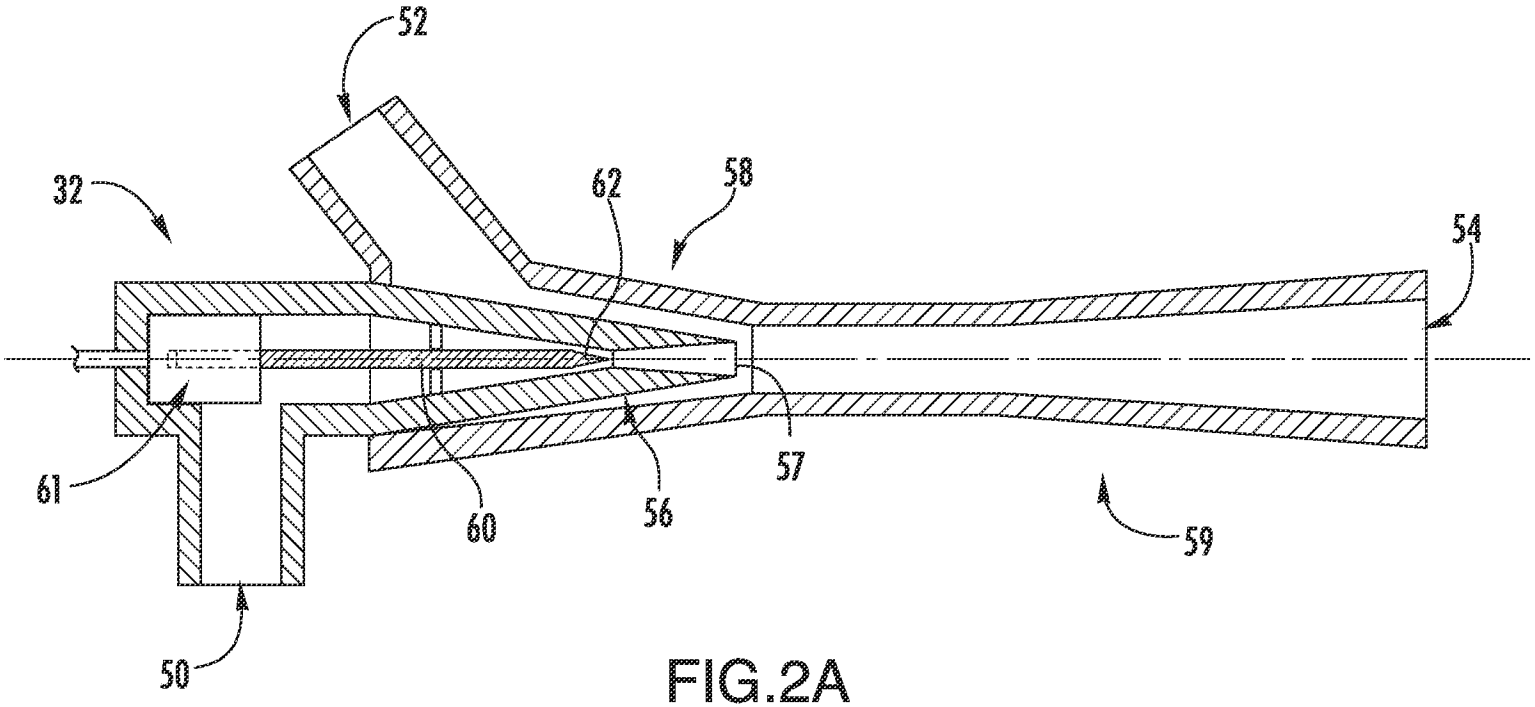
FIG. 2A is a schematic view of the ejector in the first heating mode.

In the operational modes depicted in FIG. 1 and FIG. 3, the needle 60 is in its closed position to block/prevent ejector motive flow as depicted in FIG. 1A. In the operational mode depicted in FIG. 2, the needle is in an open position permitting a motive flow as depicted in FIG. 2A.

The separator 34 comprises a vessel 70 having an inlet port 72, a vapor outlet 74, and a liquid outlet 76. A liquid phase may accumulate in a lower portion of the vessel and a vapor phase in its headspace. A compressor suction line 80 extends between vapor outlet 74 and the compressor suction port 40.

Interconnecting the various components are a plurality of conduits (lines) and a plurality of additional components including valves, filters, strainers, and the like. As is discussed further below, the valves include a four-way switching valve 100 having a first port 102. The first port serves as an inlet connected to the discharge port 42 of the compressor via an associated discharge line 110 to receive a flow 600 of compressed refrigerant. The switching valve 100 further comprises a second port 104, a third port 106, and a fourth port 108. The exemplary switching valve is configured with a rotary valve element 112 (in housing 114) having passageways for establishing two conditions of operation: selectively placing the first port 102 in communication with one of the third port and fourth port while placing the second port 104 in communication with the other. Actuation of the valve element 112 between these two conditions, along with other valve actuations discussed below, facilitates transition between the respective three modes of operation of FIGS. 1-3. The switching valve may include an actuator (not shown) to effectuate switching the four-way switching valve 100 between the two conditions, such as a rotary actuator to drive rotation of the valve element 112 between the two conditions.

FIG. 1 further shows a controllable valve 120 (e.g., an on-off solenoid valve or, among examples, a motorized, pneumatic, hydraulic valve as may be the other bistatic on-off valves discussed) having ports 122 and 124 and a check valve (one-way valve) 130 having ports 132 and 134. In an embodiment, the expansion device 28 and valve 120 are in a line 140 (one of the aforementioned conduits) between the two heat exchangers (an inter-heat exchanger line). The check valve 130 is in a branch line 144 extending from the separator liquid outlet 76 to the inter-heat exchanger line 140. The line 144 and associated flowpath segment joins the inter-heat exchanger line 140 at a junction 146 between the expansion device 28 and controllable valve 120.

A motive flow line 148 and associated flowpath segment extends from a junction 150 with the inter-heat exchanger line 140 to the ejector motive flow inlet 50. Additionally, in an embodiment, additional lines and their associated flowpaths include: a line 152 from the port 104 to the ejector secondary inlet 52; a line 154 from the port 106 to the first heat exchanger first port (cooling mode inlet) 162; and a line 156 from the second heat exchanger second port (cooling mode outlet) 168 to the port 108.

The FIG. 1 cooling mode effectively disables the ejector (e.g., no motive flow) and relies on one or more of the other expansion devices. In this specific example, the expansion device 28 is utilized. Refrigerant compressed by the compressor 22 passes through the switching valve 100 to the heat exchanger 24. The two exemplary heat exchangers each have two general places for flow inlet or outlet. In the heat exchanger 24, these two places include a first port 162 coupled to receive refrigerant from the compressor, and a second port 164 positioned to pass refrigerant to the heat exchanger 26 (via the expansion device(s) 28).

In the FIG. 1 cooling mode, the valve 120 is open allowing refrigerant to pass through the inter-heat exchanger line 140 from the second port 164 of the heat exchanger 24 through the expansion device 28 and to the port 166 of the heat exchanger 26. With the ejector needle closed, no flow would pass along the motive flow line 148 to the ejector motive flow inlet 50. This line 148 branches off from the inter-heat exchanger line 140 or flowpath between the valve 120 and the heat exchanger 26 so as to allow the diversion discussed below relative to the FIG. 2 heating mode.

In the FIG. 1 cooling mode, refrigerant exiting the second port 168 of the second heat exchanger 26 proceeds along line 156 and its associated flowpath segment to port 108 of the four-way valve 100 and, therefrom, through port 104 and line 152 to the ejector suction port 52. This flow then continues through the ejector to the separator inlet 72. However, the second heat exchanger 26 imposes a pressure drop. Thus, the pressure at the separator will be less than the pressure upstream of the second heat exchanger 26. This pressure difference is essentially imposed across the check valve 130 in the opposite of its preferred flow direction. Accordingly, there will be no flow through the check valve 130 and the separator 34 will instead behave as an accumulator.

A defrost mode (not shown) for defrosting the heat exchanger 24 may be similar to the FIG. 1 cooling mode. For example, an electric fan 169 that would normally drive an air flow across the heat exchanger 24 may be shut down to limit heat rejection in the heat exchanger 24. This will raise the temperature of refrigerant delivered to the heat exchanger 24 to cause the heat exchanger 24 to reject heat to melt any ice buildup. An electric heater (not shown) downstream of the heat exchanger 26 along an air flowpath driven by an indoor fan 171 may heat the indoor air to avoid undesirable cooling of indoor air by the heat exchanger 26.

The FIG. 2 heating mode utilizes the ejector 32 as an ejector/expansion device. To switch into this mode (or the FIG. 3 heating mode discussed below) the switching valve 100 is actuated from its FIG. 1 condition to its FIG. 2/3 condition. In this condition, flow communication is established between the ports 102 and 108 and separate flow communication is established between the ports 104 and 106. The result is that the flow 600 of compressed refrigerant is delivered from the compressor to the second heat exchanger 26 (via port 168) and refrigerant passing from the first heat exchanger 24 is passed to the ejector suction port 52. In this implementation, the FIG. 2 refrigerant flow through the heat exchanger 26 is in the opposite direction of that of FIG. 1. Similarly, the flow through the expansion device 28 and first heat exchanger 24 is in the opposite direction of that of FIG. 1.

In the FIG. 2 heating mode, there is a motive flow through the ejector to entrain/drive the ejector suction flow. To provide such motive flow, the valve 120 is closed by the controller 400. In the FIG. 1 and FIG. 3 modes, the valve 120 is open. In the FIG. 2 mode, refrigerant passes along the discharge line 110 from the compressor discharge port to the port 102 of the valve 100 and then passes through port 108 to the line 156 extending to the heat exchanger 26.

The FIG. 2 mode may be used in situations where ejector heat pumps are efficient. For example, as noted above, this may be relevant where there is a relatively high temperature difference between indoor and outdoor conditions.

The FIG. 3 heating mode effectively disables the ejector (e.g., no motive flow) and relies on the expansion device 28. As noted above, his mode may be used when an ejector is less efficient such as when there is a low temperature difference between indoor and outdoor conditions. Relative to the FIG. 2 mode, the valve 120 is open and the direction of pressure difference across the check valve 130 (higher pressure at port 132 than at port 134) means there is no flow through the separator liquid outlet (so that the separator serves as an accumulator). Accordingly, fluid passes directly from the heat rejection heat exchanger(s) 26 to the expansion device(s) 28 via the line 140.

FIG. 1 further shows a controller 400. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Figure 4:
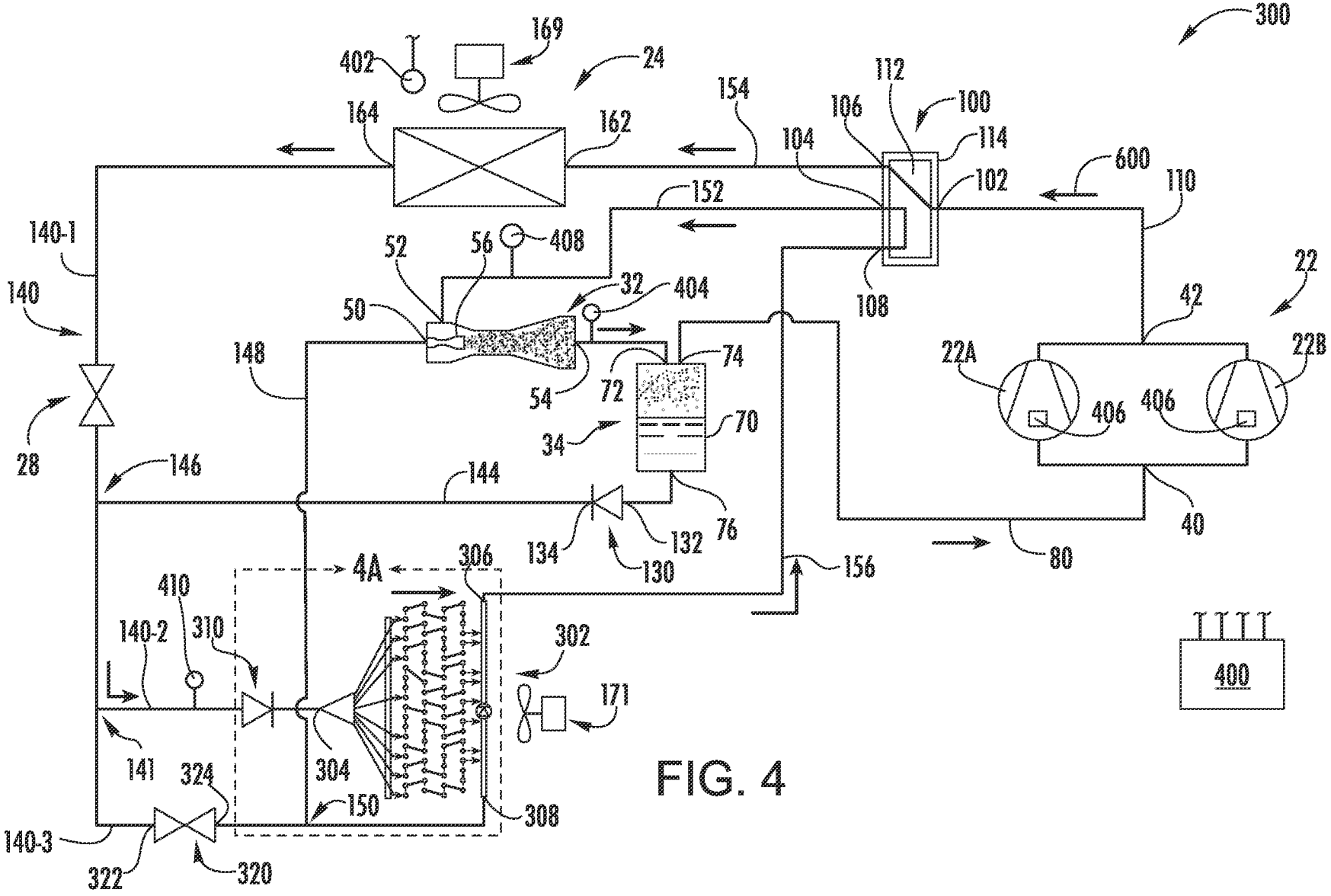
FIG. 4 is a schematic view of a second vapor compression system showing refrigerant flow directions associated with a cooling mode.
Figure 5:
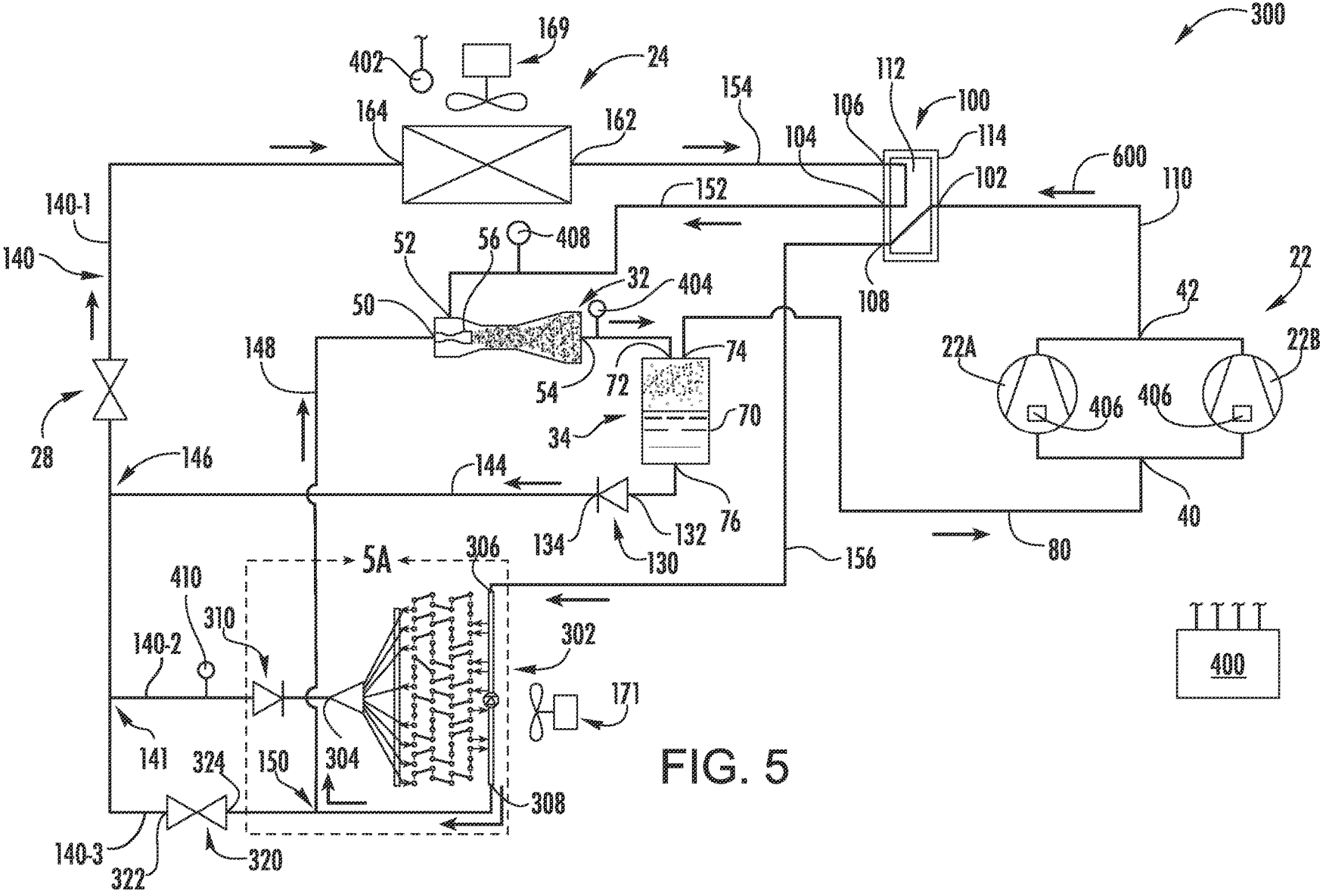
FIG. 5 is a schematic view of the system of FIG. 4 showing refrigerant flow directions associated with a first heating mode.
Figure 6:
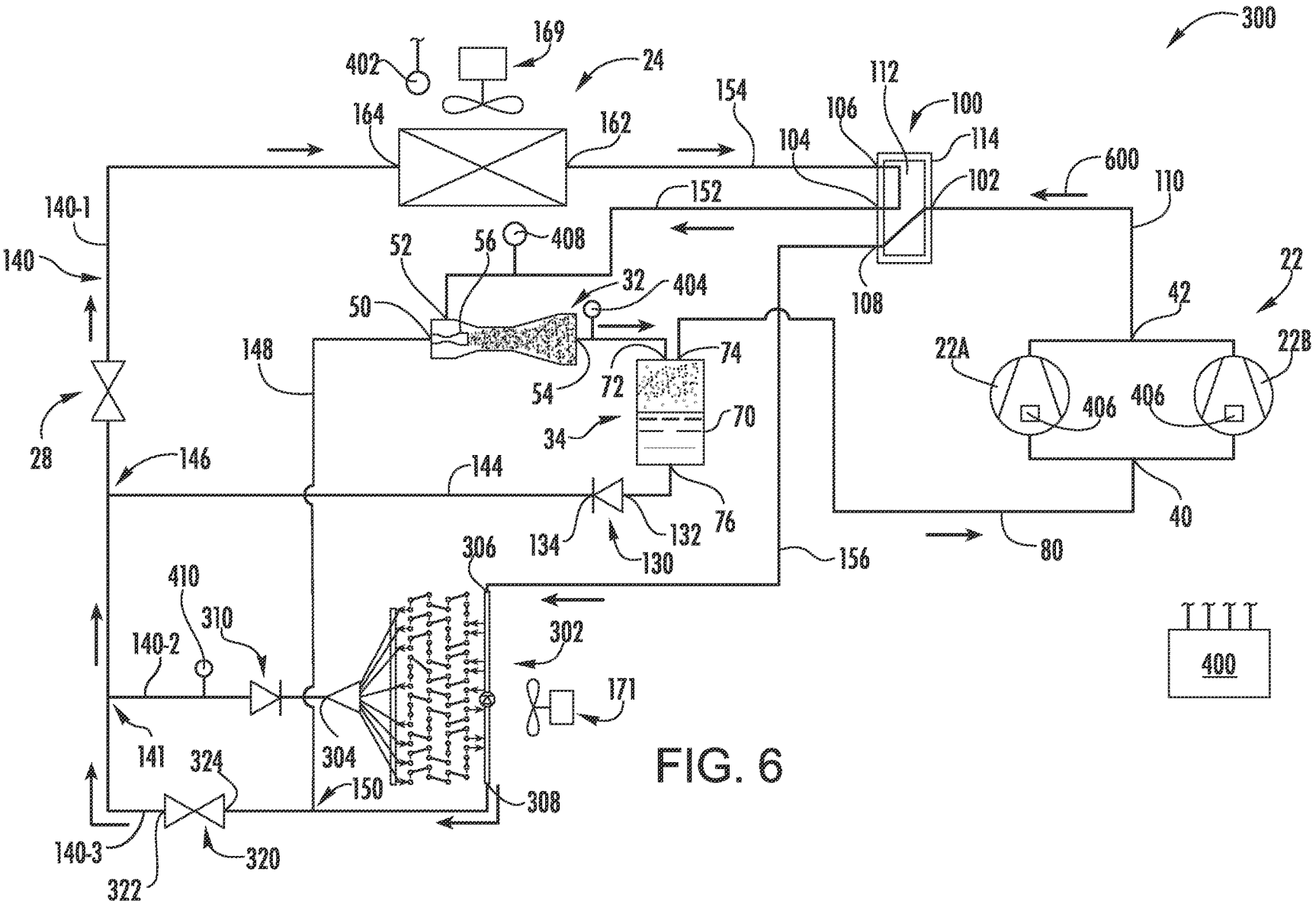
FIG. 6 is a schematic view of the system of FIG. 4 showing refrigerant flow directions associated with a second heating mode.

FIGS. 4-6 show a second system 300 that may be otherwise similar to the system 20 in structure, manufacture, and operation. FIG. 4, FIG. 5, and FIG. 6 show modes similar to the respective FIG. 1, FIG. 2, and FIG. 3 modes. Actuation of the ejector needle to switch between the respective modes may be the same as that for the system 20. Differences include the indoor heat exchanger 302 contrasting with the indoor heat exchanger 26, the addition of a check valve 310 (discussed below) and the use of an on-off valve 320 in place of the valve 120. The valve 320 (having ports 322 and 324) may be of similar structure to the valve 120 but is actuated in different circumstances. The indoor heat exchanger 302 has three ports 304, 306, and 308.

The inter-heat exchanger line 140 splits, having a trunk 140-1 extending from the outdoor heat exchanger 24 to the expansion device 28. The inter-heat exchanger line 140 has a pair of branches 140-2 and 140-3. The first branch 140-2 extends between a junction 141 with the second branch 140-3 and the port 304. The check valve 310 is along this branch and associated flowpath leg. The check valve 310 is oriented to permit flow into the port 304 but not out from the port 304. The second branch 140-3 and associated flowpath leg extends to the port 308. The valve 320 is located along this branch and flowpath leg. Similarly, the junction 150 is along this branch and flowpath leg.

Figure 4A:
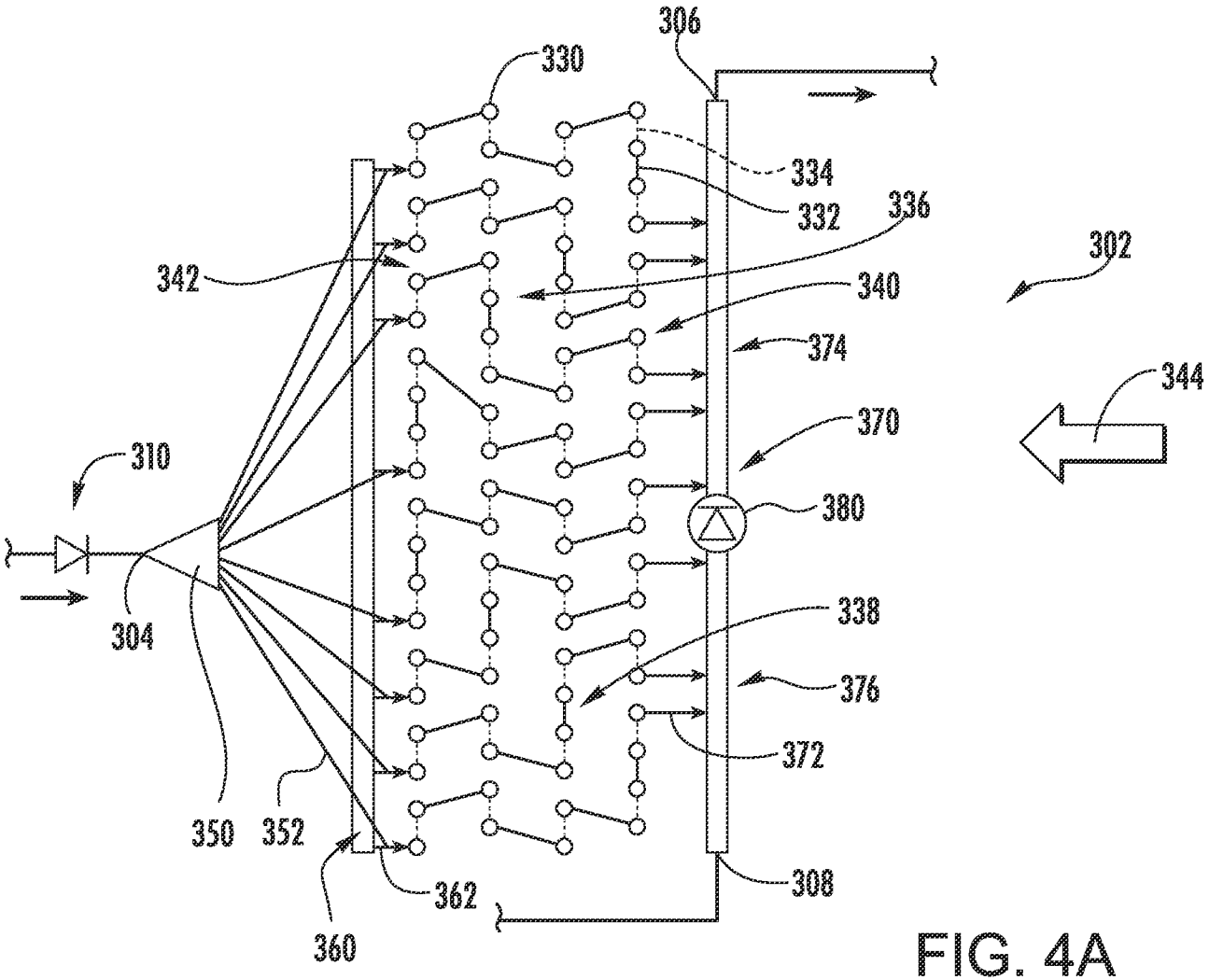
FIG. 4A is a schematic view of an indoor heat exchanger of the system of FIG. 4.

The heat exchanger 302 comprises an array or bundle of tubes (tube lengths/legs) 330 (FIG. 4A). The tube array comprises tube lengths extending between a first side and a second side with respective connectors 332 and 334 joining tube legs at the first side and second side. The array of tubes has a first face 340 and a second face 342. In the exemplary implementation, the face 340 is upstream in the direction of an airflow 344 (e.g., fan-forced) and the face 342 is downstream. The tubes are connected to several manifolds for inlet and/or outlet of refrigerant. A first manifold is formed by a distributor 350 whose inlet is formed by the port 304 and which becomes operational in the FIG. 4 cooling mode. The distributor has individual branches 352 extending to associated tube legs. A second manifold 360 is a header in parallel with the distributor 350 and is relevant in heating modes (FIGS. 5 and 6) wherein there is no flow through the inlet 304. The exemplary header 360 has branches 362 connecting with the associated respective legs. In an embodiment, the header 360 is an existing header of a baseline heat exchanger and the distributor and its branches are added with the branches 352 patching into respective associated branches 362.

In an embodiment, the tube array is divided into two respective sections 336 and 338. In the heating modes, the header 360 serves to pass refrigerant sequentially from the section 336 to the section 338. The sequential arrangement increases the refrigerant flowpath length of a pass through the indoor heat exchanger relative to the cooling mode. This increased length enables increased pressure drop corresponding to increased heat transfer duty for a given heat exchanger size and general construction.

The sequential flow is not needed in the cooling mode. In the cooling mode, the heat exchanger 302 is an evaporator where extra length would provide superheat instead of subcooling. But this would require a high penalty in heat exchanger size and pressure drop to the decreased density of the superheated refrigerant. In contrast heating mode subcooling does not involve such a penalty due to the high density of the subcooled refrigerant.

To allow such sequential passage, a third manifold 370 is formed as a second header including the ports 306 and 308. The manifold 370 has associated branches 372 in communication with the adjacent legs of the heat exchanger. To facilitate the heating mode operation, the manifold 370 is divided by a check valve 380 into a first portion 374 and a second portion 376 (alternatively, these may be viewed as separate manifolds).

The check valve 380 is positioned to allow flow from the section 376 to the section 374 but not flow in the opposite direction. Accordingly, in the FIG. 4 cooling mode, refrigerant passes from the compressor through the expansion device 28 as in the FIG. 1 mode. As noted above, unlike the FIG. 1 mode, the valve 320 is closed so that flow passes along the branch 140-2 through the check valve 310 to the inlet 304 and distributor 350. With the closure of the ejector needle and the closure of the valve 320, there is no flow to pass through the port 308 along the branch 140-3. Accordingly, refrigerant passes through the distributor, through the lines 352, and through both sections 336 and 338 of the tube bundle in parallel to the manifold 370. The portion of the flow reaching the manifold section 376 will pass through the check valve 380 and then to the manifold section 374 and therefrom out the port 306 to ultimately pass to the ejector secondary port 52.

In the heating modes (FIGS. 5 and 6), flow enters the port 306, passes through the section 374 (FIG. 5A) of the manifold 370 to the section 336 of the tube bundle and, therefrom, into the manifold 360. From the manifold 360, the refrigerant passes back into the section 338 of the tube bundle and, therefrom, into the section 376 of the manifold 370 to then exit the port 308 to pass through the valve 320 to the expansion device 28. The check valve 310 blocks (prevents) flow out of the port 304 and thus effectively blocks flow from the tube bundle into the distributor.

The positioning of the check valve 380 (FIG. 5A) determines the relative sizes of the two sections 336 and 338 of the tube bundle. The illustrated example places five circuits in the bundle 336 and three in the bundle 338. The size balance between the two sections will depend on the properties of the refrigerant, heat exchanger geometry, and the target operating temperature. The condensing of the refrigerant will be expected to be associated with a smaller number of circuits in the bundle section 338 which receives at least partially condensed refrigerant from the bundle section 336. Thus, the separation into two sections and the alternate parallel and series flows provides additional refrigerant flowpath length when rejecting heat vs. absorbing heat. The extra length imposes extra pressure difference. When rejecting heat, the pressure drop impacts performance less than when absorbing heat.

A control routine may be programmed or otherwise configured into the controller 400. The routine provides automatic selection of which of the two heating modes to use based on sensed conditions. In a reengineering of a baseline heat pump system, this selection may be superimposed upon the controller's normal programming/routines (e.g., providing the basic operation of baseline system to which the foregoing mode control is added). In one example, the switching of the two heating modes can be controlled responsive only to the outdoor ambient temperature sensor 402 and/or pressure sensors (transducers) 404 (positioned to sense pressure at the ejector outlet 54) and 408 (positioned to sense pressure at the secondary inlet 52), and/or the compressor speed signal (from a sensor 406 or logic internal to the controller). The controller may determine a pressure difference between the pressure sensors 404 and 408. In an exemplary control routine, the ejector can be enabled during the heating mode once the temperature sensor 402 reading is below a threshold (e.g., 32° F. (0° C.)), and/or once the pressure difference is less than a certain target number (e.g., 2psid (14 kPa)), and/or once the compressor reaches its minimum speed. Although a single compressor may be used, two are shown and may be used according to known methods for optimizing load handling.

In the FIG. 2 or FIG. 4 ejector modes, the ejector needle 60 may be positioned by the controller controlling the actuator 61 responsive to a control algorithm based on operating pressure sensed by a sensor 410 (e.g., positioned to measure pressure between motive inlet and the indoor heat exchanger 26). To optimize ejector efficiency, the pressure at that location can be regulated by adjusting the ejector needle with the objective of providing the optimum degree of refrigerant subcooling leaving the heat exchanger 26, through port 166. This may be done according to known needle control procedures for ejector refrigeration systems.

Figure 7:
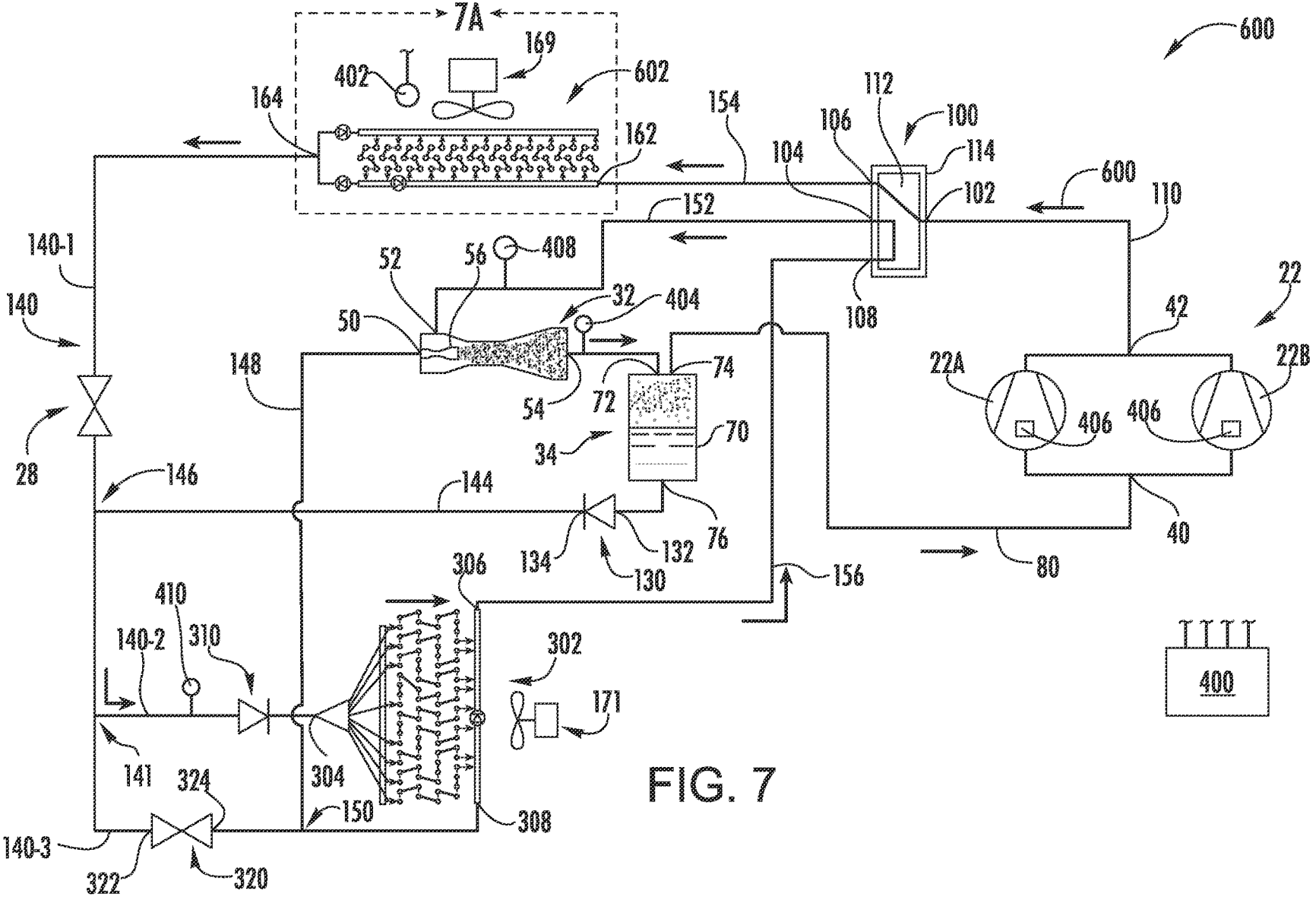
FIG. 7 is a schematic view of a third vapor compression system showing refrigerant flow directions associated with a cooling mode.
Figure 8:
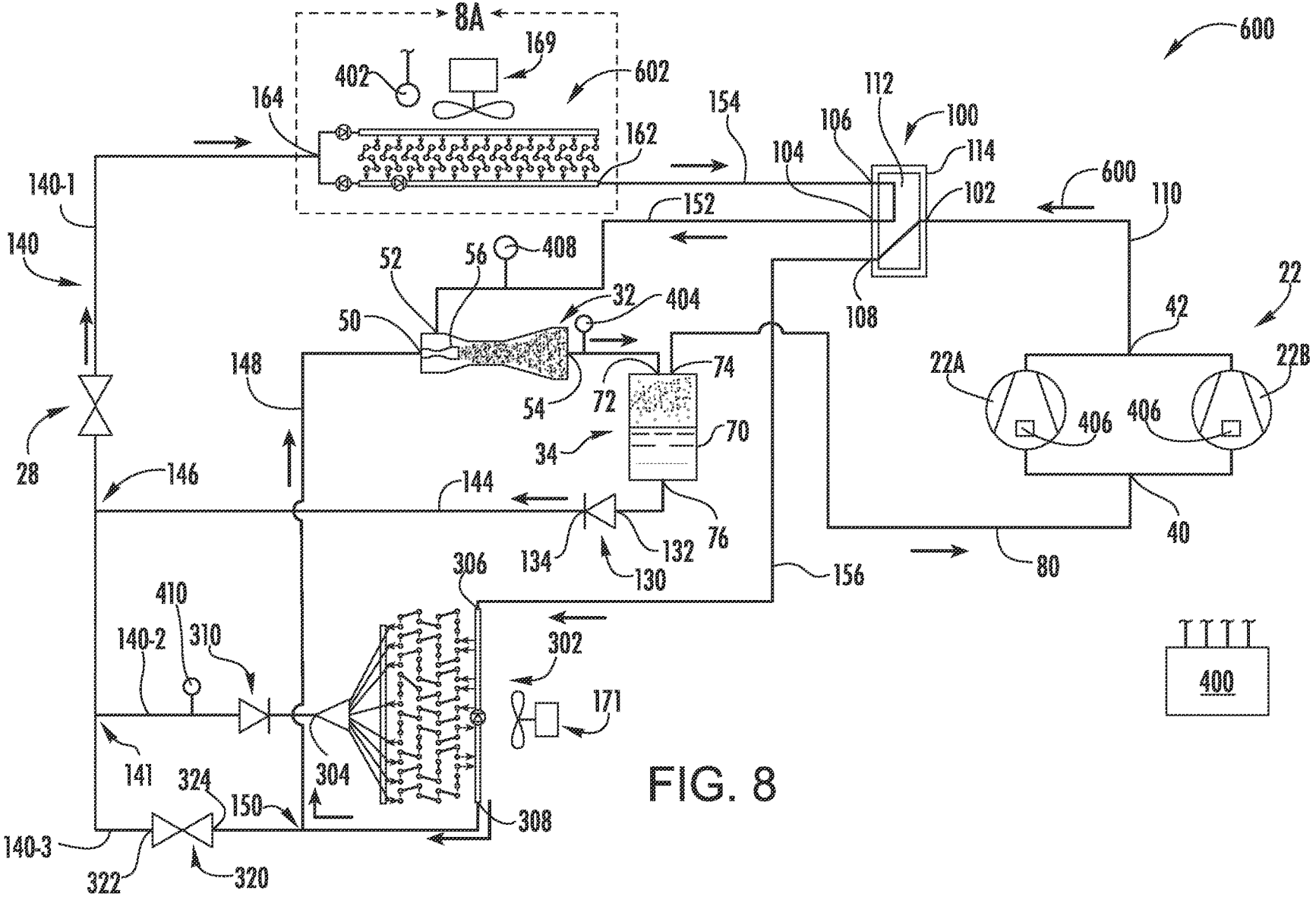
FIG. 8 is a schematic view of the system of FIG. 7 showing refrigerant directions associated with a first heating mode.
Figure 8A:
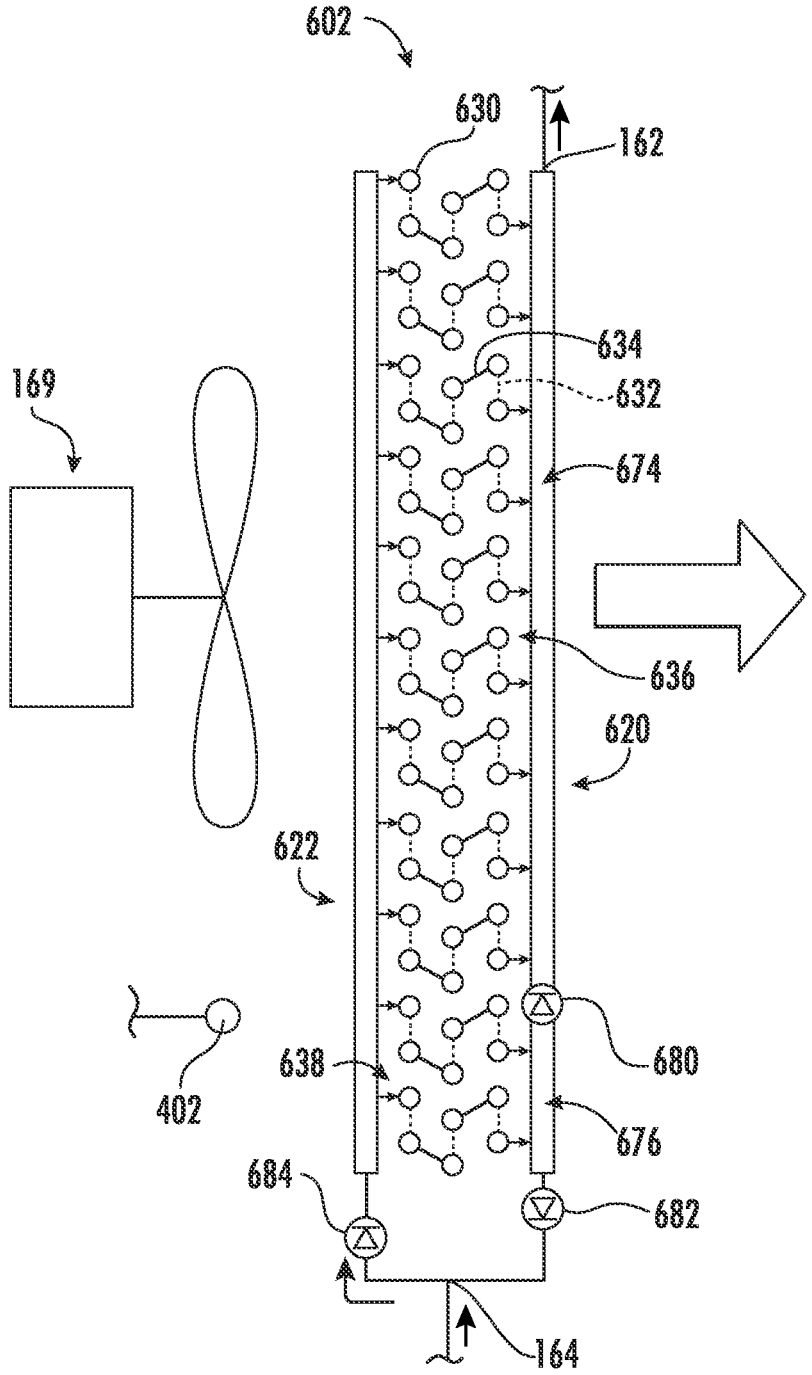
FIG. 8A is a schematic view of the outdoor heat exchanger of the system of FIG. 8.
Figure 9:
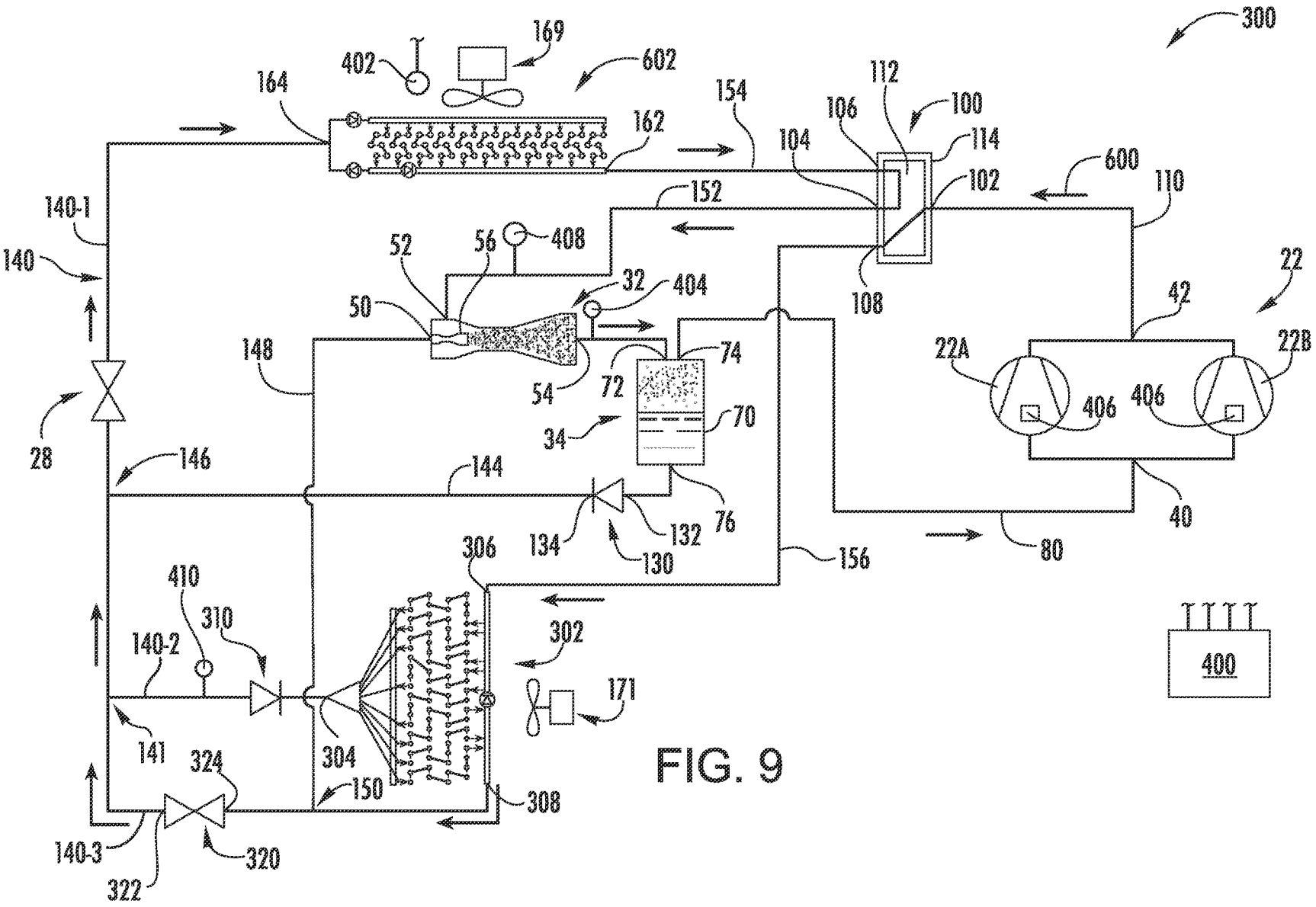
FIG. 9 is a schematic view of the system of FIG. 7 showing refrigerant flow directions associated with a second heating mode.

FIGS. 7-9 show a third system 600 that may be otherwise similar to the systems 20 and 300 in structure, manufacture, and operation. FIGS. 7, 8, and 9 show modes similar to the respective FIGS. 1/4, 2/5, and 3/6 modes. Actuation of the ejector needle to switch between the respective modes may be the same as that for the systems 20 and 300. Differences include the outdoor heat exchanger 602 contrasting with the outdoor heat exchanger 26 in similar fashion to the contrasting of the indoor heat exchanger 302 with the indoor heat exchanger 26.

Figure 7A:
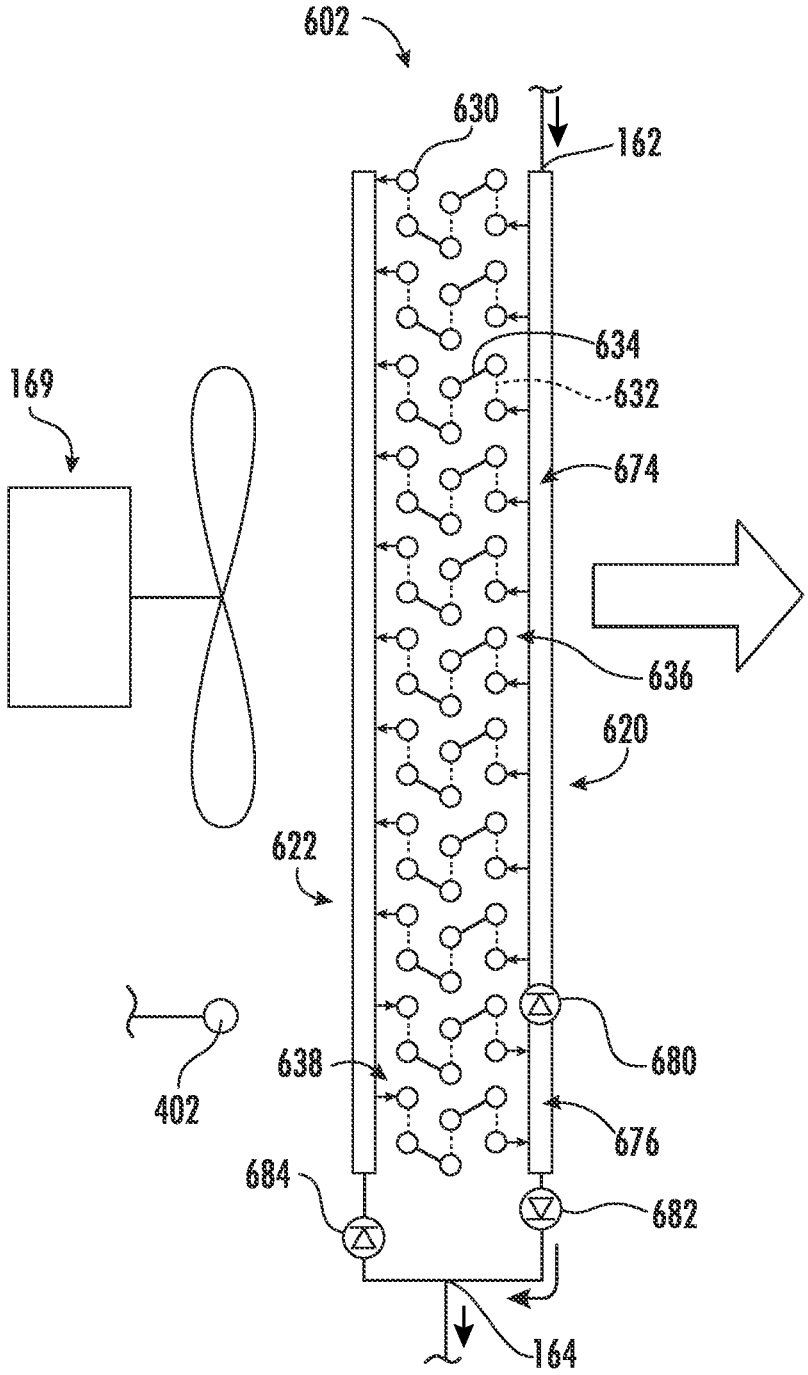
FIG. 7A is a schematic view of an outdoor heat exchanger of the system of FIG. 7.

Specifically, the example outdoor heat exchanger 602 has manifolds 620 and 622 forming headers for an array or bundle of tubes 630 (FIG. 7A). The tubes have similar connectors 632, 634 to the FIG. 4A heat exchanger 320. Other similarities are not discussed.

In similar fashion to the manifold/header 370, the manifold/header 620 is divided by a check valve 680 into a first portion or section 674 and a second portion or section 676 (alternatively, these may be viewed as separate manifolds). The check valve 680 is positioned to allow flow from the second portion 676 to the first portion 674 but not flow in an opposite direction. The end of the first portion 674 opposite the check valve 380 forms the port 162 or is otherwise open thereto. The end of the second portion 676 opposite the check valve 680 is in communication with an oppositely-oriented second check valve 682. Thus, the check valves 680 and 682 are positioned to permit outlet flow from their respective ends of the second portion 676 but not inlet flow. Inlet flow to the second portion 676 is limited to flow from the array or bundle of tubes 630.

In example implementations, the outdoor heat exchanger 602 is configured as an updraft draw-through heat exchanger where the fan is at the top and the bundle 630 extends around a lateral periphery with the manifolds 620, 622 vertically oriented to form a pair of headers. The headers 620, 622 extend vertically close to each other (e.g., near one corner of a rounded square footprint outdoor heat exchanger) with the tube bundle either being generally the major arc of a circle or a rounded corner square (with inter-header gap at one corner). The headers 620, 622 may be formed of pipestock/tubestock. For example, the check valve 680 may be a conventional check valve fitting inline between respective pieces (e.g., straight pieces) of pipestock/tubestock forming the manifolds 674 and 676. The valves 682 and 684 may be at ends of the pieces forming manifolds 676 and 622 or at ends of elbows between those and the junction (e.g., Y fitting or T fitting) forming or leading to the port 164.

The manifold 622 has a closed end and an opposite end in communication with a check valve 684 positioned to permit inflow to the header 622 but not outflow from the header. The opposite ends of the check valves 682 and 684 are connected in parallel to the port 164. The groups of tubes forming the section 638 connect to the manifold 676; whereas, groups of tubes forming the section 636 connect to the manifold 674.

Thus, in the FIG. 7 cooling mode, the inlet flow passes through the port 162 into the manifold 674 and then through the associated tubes of the section 636 into the manifold 622. Outflow from the manifold 622 to the port 164 is blocked by the check valve 684. Accordingly, the flow then passes through the tubes of the section 638 to the manifold 676 and exits to the outlet 164 via the check valve 682.

In contrast, in the FIG. 8/8A heating mode (otherwise similar to the FIG. 5 heating mode), flow enters the port 164. The check valve 682 blocks inflow to the manifold 676; whereas, the check valve 684 allows inflow to the manifold 622. Flow can exit the manifold 622 through both tube bank sections 636 and 638. Flow passing through the section 636 passes directly to the manifold 674 and out the outlet 162. Flow passing through the section 638 passes to the manifold 676, and therefrom through the check valve 680 into the manifold 674 to exit the port 672.

Thus, in the FIG. 7 cooling mode, the flow through the outdoor heat exchanger 602 is sequential from the inlet 162, through the manifold 674, the tubes forming the section 636, the manifold 622, through the tubes forming the section 638, the manifold 676 and then the check valve 682 to the outlet 674. The series flow increases the length of flowpath within the heat exchanger 602 experienced by the refrigerant and thus increases subcooling. Similarly, the flow restriction (of first using the majority section 636 but then using a smaller section 638) increases pressure drop (to further increase subcooling) vs using both groups in parallel. In contrast, the FIG. 8 heating mode has flow through both groups in parallel with the flow through the section 636 being in opposite direction to the cooling mode and the flow through the section 638 being in the same direction as in the cooling mode.

The positioning of the check valve 680 (FIG. 7A) determines the relative sizes of the two sections 636 and 638 of the tube bundle. In the FIGS. 7-9 embodiment, the size of the section 636 is greater than that of the section 638. Specifically, each section is composed of series groups of tubes between the associated manifolds. The section 636 has a larger number of groups (nine in the illustration) than does the section 638 (two in the illustration). The size balance between the two sections will depend on the properties of the refrigerant, heat exchanger geometry, and the target operating temperature. The condensing of the refrigerant will be expected to be associated with a smaller number of circuits in the bundle section 638 which receives partially condensed refrigerant from the bundle section 636 in the cooling mode.

Figure 5A:
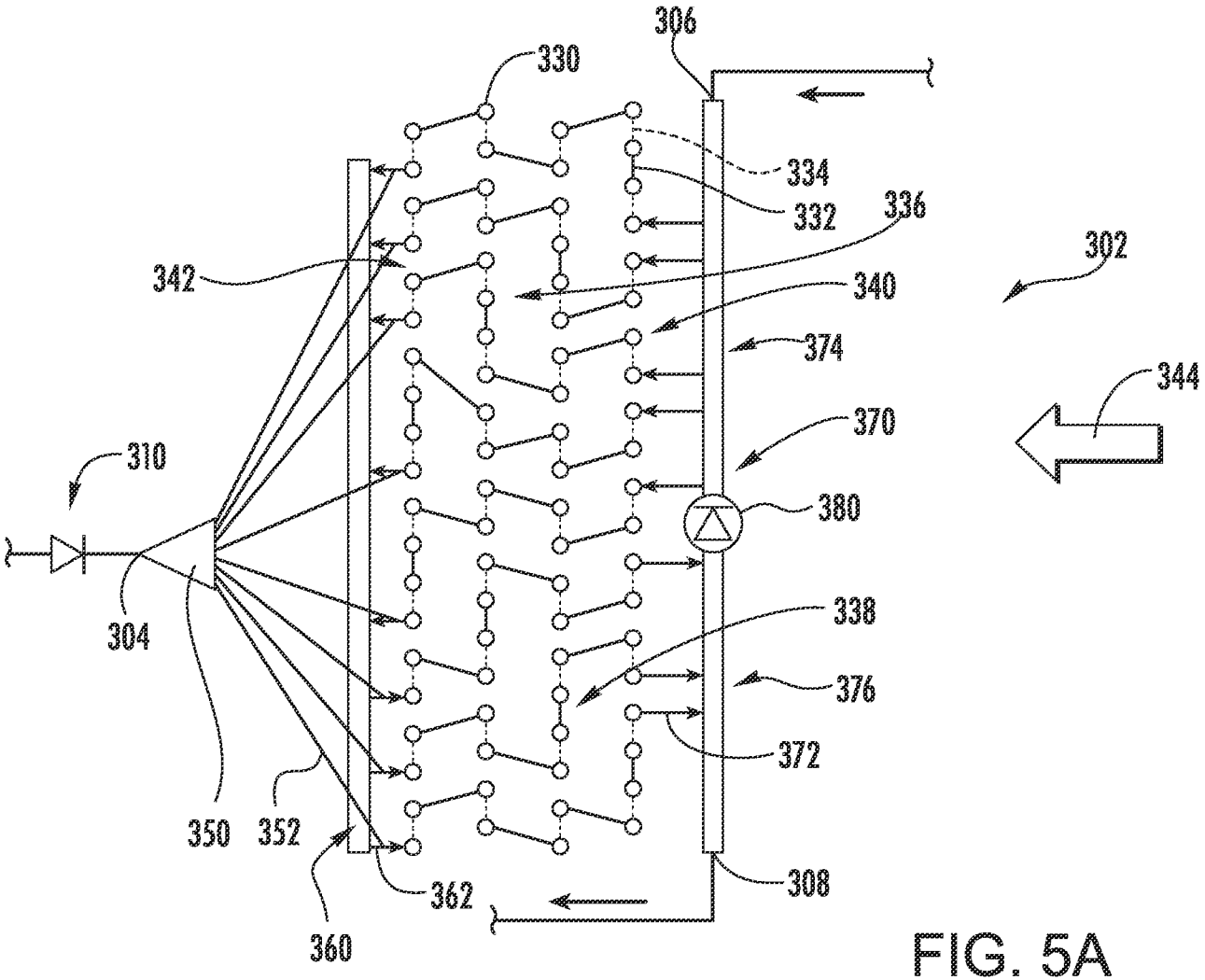
FIG. 5A is a schematic view of the indoor heat exchanger of the system of FIG. 5.

As noted above, a similar situation attends the indoor heat exchanger 302. The indoor heat exchanger 302 has flow in parallel through the sections 336 and 338 in the FIG. 4 cooling mode and series flow from the section 336 to the section 338 in the heating mode (FIG. 5A). The example indoor heat exchanger 302 has a more even balance of groups (lower size ratio of the groups) in the two sections with five groups in the example section 336 and three groups in the example section 338. This is due to significant geometric considerations when comparing indoor heat exchanger 302 and outdoor heat exchanger 602. This includes considerations of size and airflow. The outdoor heat exchanger can be larger. Particularly, when fixed speed fans are used, the outdoor heat exchanger can have greater airflow.

Additionally, the example outdoor heat exchanger 602 lacks the distributor 350 of the indoor heat exchanger 302. This is because in the cooling mode the flow downstream of the expansion device 28 is two-phase so the distributor distributes uniformly to the indoor heat exchanger. In the ejector heating mode, the expansion device does not expand refrigerant so that relatively "low quality" (mostly liquid) or all liquid refrigerant enters the outdoor heat exchanger 602.

In the ejector heating mode of FIG. 8, the liquid refrigerant leaves the separator 70 through port 76 and said liquid refrigerant is evenly distributed into the outdoor heat exchanger (acting as an evaporator) 602 via port 164. In the outdoor heat exchanger it is fully vaporized before leaving via port 162.

In FIG. 9, higher quality two-phase flow enters at port 164 instead of the FIG. 8 lower quality (e.g., single phase liquid). Inefficiency due to maldistribution of the two-phase flow entering the heat exchanger is minor given lower expected use of the FIG. 9 mode relative to the FIG. 8 mode. In some implementations, the control may be configured to never use the FIG. 9 mode.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A system (300; 600) comprising:

a compressor (22) having a suction port (40) and a discharge port (42);

an ejector (32) having a motive flow inlet (50), a suction flow inlet (52), and an outlet (54), the ejector being a controllable ejector having a needle (60) shiftable between a closed position and a plurality of open positions;

a separator (34) having an inlet (72), a vapor outlet (74), and a liquid outlet (76);

a first heat exchanger (24; 602);

an expansion device (28);

a second heat exchanger (302) having a first section (336) and a second section (338); and a plurality of conduits (80, 110, 140, 144, 148, 152, 154, 156) and a plurality of valves (100, 130, 310, 320, 380; 100, 130, 310, 320, 380, 680, 682, 684) positioned to provide alternative operation in:

a cooling mode wherein the needle is in the closed position to block flow from the motive flow inlet; and a heating mode wherein a flowpath segment passes from the second heat exchanger through the motive flow inlet, the separator inlet and liquid outlet, and the expansion device and to the first heat exchanger, wherein the plurality of valves are positioned so that:

in the heating mode refrigerant passes sequentially from the first section (336) to the second section (338); and in the cooling mode refrigerant passes in parallel through the first section (336) and the second section (338).

2. The system of claim 1 wherein:

the first heat exchanger (602) comprises:

a first manifold (674);

a second manifold (676); and a third manifold (622);

in the cooling mode refrigerant passes through a first section (636) of the first heat exchanger and a second section (638) of the first heat exchanger in series; and in the heating mode refrigerant passes through the first section of the first heat exchanger and the second section of the first heat exchanger in parallel.

3. The system of claim 2 wherein:

the first heat exchanger first section is larger than the first heat exchanger second section; and the second heat exchanger first section is larger than the second heat exchanger second section.

4. The system of claim 3 wherein:

a size ratio of the first heat exchanger first section to the first heat exchanger second section is smaller than a size ratio of the second heat exchanger first section to the second heat exchanger second section.

5. The system of claim 1 wherein:

the system has only a single ejector.

6. The system of claim 1 wherein:

the heating mode is a first heating mode;

the plurality of conduits and the plurality of valves are further positioned to provide alternative operation in a second heating mode wherein the needle is in the closed position to block flow from the motive flow inlet; and the plurality of valves are positioned so that in the second heating mode refrigerant passes sequentially from the first section to the second section.

7. The system of claim 6 further comprising a controller (400) configured to switch the system between:

running in the cooling mode;

running in the first heating mode; and running in the second heating mode.

8. The system of claim 7 wherein the controller (400) is configured to switch the system between said first heating and said second heating mode based on a sensed outdoor temperature.

9. The system of claim 1 wherein:

the first heat exchanger (602) comprises:

a first port (162); a second port (164);

a first check valve (680) of said plurality of valves positioned to block flow from the first manifold to the second manifold;

a second check valve (682) of said plurality of valves positioned to block flow from the second port to the second manifold; and a third check valve (684) of said plurality of valves positioned to block flow from the third manifold (622) to the second port.

10. A system (600) comprising:

a compressor (22) having a suction port (40) and a discharge port (42);

an ejector (32) having a motive flow inlet (50), a suction flow inlet (52), and an outlet (54), the ejector being a controllable ejector having a needle (60) shiftable between a closed position and a plurality of open positions;

a separator (34) having an inlet (72), a vapor outlet (74), and a liquid outlet (76);

a first heat exchanger (602);

at least one expansion device (28);

a second heat exchanger (302); and a plurality of conduits (80, 110, 140, 144, 148, 152, 154, 156) and a plurality of valves (100, 130, 310, 320, 380, 680, 682, 684) positioned to provide alternative operation in:

a cooling mode wherein a flowpath segment passes from the first heat exchanger through a first expansion device (28) of the at least one expansion device to the second heat exchanger and the needle is in the closed position to block flow from the motive flow inlet;

a first heating mode wherein a flowpath segment passes from the second heat exchanger through the motive flow inlet, the separator inlet and liquid outlet, and the first expansion device and to the first heat exchanger; and a second heating mode wherein:

a flowpath segment passes from the second heat exchanger through the first expansion device to the first heat exchanger; and the ejector has a suction flow and the needle is in the closed position to block flow from the motive flow inlet, wherein:

the first heat exchanger comprises:

a first manifold (674);

a second manifold (676); and a third manifold (622);

in the cooling mode refrigerant passes through a first section of the first heat exchanger and a second section of the first heat exchanger in series; and in the first heating mode refrigerant passes through the first section of the first heat exchanger and the second section of the first heat exchanger in parallel.

11. The system of claim 10 wherein:

the first heat exchanger (602) comprises:

a first port (162); a second port (164);

a first check valve (680) of said plurality of valves positioned to block flow from the first manifold to the second manifold;

a second check valve (682) of said plurality of valves positioned to block flow from the second port to the second manifold; and a third check valve (684) of said plurality of valves positioned to block flow from the third manifold (622) to the second port.

12. A system (600) comprising:

a compressor (22) having a suction port (40) and a discharge port (42);

an ejector (32) having a motive flow inlet (50), a suction flow inlet (52), and an outlet (54), the ejector being a controllable ejector having a needle (60) shiftable between a closed position and a plurality of open positions;

a separator (34) having an inlet (72), a vapor outlet (74), and a liquid outlet (76);

a first heat exchanger (602);

at least one expansion device (28) other than the ejector;

a second heat exchanger (302); and a plurality of conduits (80, 110, 140, 144, 148, 152, 154, 156) and a plurality of valves (100, 130, 310, 320, 380, 680, 682, 684) positioned to provide alternative operation in:

a cooling mode wherein a flowpath segment passes from the first heat exchanger through a first expansion device (28) of the at least one expansion device to the second heat exchanger and the needle is in the closed position to block flow from the motive flow inlet; and a first heating mode wherein a flowpath segment passes from the second heat exchanger through the motive flow inlet, the separator inlet and liquid outlet, and the first expansion device and to the first heat exchanger, wherein:

the first heat exchanger comprises:

a first manifold (674);

a second manifold (676); and a third manifold (622);

in the cooling mode refrigerant passes through a first section of the first heat exchanger and a second section of the first heat exchanger in series; and in the first heating mode refrigerant passes through the first section of the first heat exchanger and the second section of the first heat exchanger in parallel.

13. The system of claim 12 wherein:

the first heat exchanger (602) comprises:

a first port (162);

a second port (164);

a first check valve (680) of said plurality of valves positioned to block flow from the first manifold to the second manifold;

a second check valve (682) of said plurality of valves positioned to block flow from the second port to the second manifold; and a third check valve (684) of said plurality of valves positioned to block flow from the third manifold (622) to the second port.

14. The system of claim 12 wherein:

the second heat exchanger (302) has a first section (336) and a second section (338); and the plurality of valves are positioned so that:

in the first heating mode refrigerant passes sequentially from the second heat exchanger first section (336) to the second heat exchanger second section (338); and in the cooling mode refrigerant passes in parallel through the second heat exchanger first section (336) and the second heat exchanger second section (338).

15. The system of claim 12 wherein:

the plurality of conduits and the plurality of valves are positioned to further provide operation in:

a second heating mode wherein:

a flowpath segment passes from the second heat exchanger through the first expansion device to the first heat exchanger; and the ejector has a suction flow and the needle is in the closed position to block flow from the motive flow inlet.

* * * * *